US012245647B2

(12) United States Patent
Ferrara

(10) Patent No.: US 12,245,647 B2
(45) Date of Patent: Mar. 11, 2025

(54) COMPOSITE DEVICES AND METHODS FOR PROVIDING PROTECTION AGAINST TRAUMATIC TISSUE INJURY

(71) Applicant: Lisa Ferrara, Hendersonville, NC (US)

(72) Inventor: Lisa Ferrara, Hendersonville, NC (US)

(73) Assignee: Lisa Ferrara, Hendersonville, NC (US)

( * ) Notice: Subject to any disclaimer, the term of this patent is extended or adjusted under 35 U.S.C. 154(b) by 339 days.

(21) Appl. No.: 17/654,812

(22) Filed: Mar. 14, 2022

(65) Prior Publication Data

US 2022/0211123 A1 Jul. 7, 2022

Related U.S. Application Data

(63) Continuation of application No. 14/910,593, filed as application No. PCT/US2015/010373 on Jan. 6, 2015, now Pat. No. 11,311,060.

(Continued)

(51) Int. Cl.

| | |
|---|---|
| ***A41D 13/00*** | (2006.01) |
| ***A41B 1/08*** | (2006.01) |
| ***A41D 1/04*** | (2006.01) |
| ***A41D 13/015*** | (2006.01) |
| ***A41D 13/05*** | (2006.01) |

(Continued)

(52) U.S. Cl.

CPC ..... *A41D 13/015* (2013.01); *A41B 1/08* (2013.01); *A41D 1/04* (2013.01); *A41D 13/0007* (2013.01); *A41D 13/0518* (2013.01); *A41D 13/0568* (2013.01); *A42B 3/064* (2013.01); *A42B 3/065* (2013.01); *A42B 3/121* (2013.01); *A42B 3/125* (2013.01); *A42B 3/128* (2013.01); *A42B 3/14* (2013.01); *A42B 3/20* (2013.01); *A63B 71/10* (2013.01); *A63B 71/12* (2013.01); *A63B 71/1225* (2013.01); *A63B 2071/1208* (2013.01); *A63B 2071/125* (2013.01); *A63B 2071/1258* (2013.01)

(58) Field of Classification Search

CPC .. A41D 13/015; A41D 13/0518; A41D 13/05; A41D 13/0525; A41D 13/0506; A41D 13/0512; A41D 13/0531; A41D 13/0537; A41D 13/0158; A41D 1/04; A63B 71/08; A63B 71/12; A63B 2071/1208; A63B 71/081; Y10T 428/24116; Y10T 428/24149; Y10T 428/24157

USPC ..... 2/456, 464, 465, 2.5, 463

See application file for complete search history.

(56) References Cited

U.S. PATENT DOCUMENTS 3,577,836 A * 5/1971 Tamura ..... A41D 31/245 428/116

3,924,038 A * 12/1975 McArdle ..... B32B 3/04 428/116

(Continued)

FOREIGN PATENT DOCUMENTS

WO WO-2006036072 A1 * 4/2006 ..... A41D 31/005

*Primary Examiner* — Amy Vanatta

(74) *Attorney, Agent, or Firm* — McNees Wallace & Nurick LLC

(57) ABSTRACT

Articles including protective gear for a variety of sports and activities provide protection from one or both of linear and angular forces that either directly or indirectly impact the gear when it is donned. The articles include at least two layers of material that provide multimodal energy dissipation to minimize the extent of transmission of impact forces to tissue.

20 Claims, 22 Drawing Sheets
(6 of 22 Drawing Sheet(s) Filed in Color)

Related U.S. Application Data

(60) Provisional application No. 61/924,171, filed on Jan. 6, 2014.

(51) Int. Cl.

| | |
|---|---|
| ***A42B 3/06*** | (2006.01) |
| ***A42B 3/12*** | (2006.01) |
| ***A42B 3/14*** | (2006.01) |
| ***A42B 3/20*** | (2006.01) |
| ***A63B 71/10*** | (2006.01) |
| ***A63B 71/12*** | (2006.01) |

(56) References Cited

U.S. PATENT DOCUMENTS 4,213,202 A * 7/1980 Larry ..... A41D 31/285 2/463
5,317,950 A * 6/1994 Binon ..... F41H 5/0478 428/116
5,349,893 A * 9/1994 Dunn ..... F41H 5/04 428/116
5,524,641 A * 6/1996 Battaglia ..... A41D 13/0153 2/463
5,804,757 A * 9/1998 Wynne ..... F41H 5/0428 2/2.5
5,978,961 A * 11/1999 Barker ..... A41D 13/0518 2/2.5
6,282,724 B1 * 9/2001 Abraham ..... A41D 13/015 2/455
8,490,213 B2 * 7/2013 Neal ..... A41D 31/245 2/2.5
10,206,437 B2 * 2/2019 Behrend ..... A41D 13/0156
2008/0040840 A1 * 2/2008 Morrow ..... A63B 71/12 2/463
2011/0167548 A1 * 7/2011 Jourde ..... A41D 13/0518 2/463
2011/0229685 A1 * 9/2011 Lin ..... F16F 7/12 428/117
2011/0252549 A1 * 10/2011 Jourde ..... A41D 13/0518 2/463
2012/0198594 A1 * 8/2012 Reay ..... A63B 71/12 2/2.5
2014/0150170 A1 * 6/2014 Kim ..... A43B 13/187 428/44
2016/0160952 A1 * 6/2016 Schaedler ..... B60N 3/048 188/377

* cited by examiner

ISO

SIDE

COMPOSITE DEVICES AND METHODS FOR PROVIDING PROTECTION AGAINST TRAUMATIC TISSUE INJURY

RELATED APPLICATIONS

This application claims priority to U.S. patent application Ser. No. 14/910,593, which claims the benefit of the filing date of PCT Application No. PCT/US15/10373 filed Jan. 6, 2015, which claims the benefit of the filing date of U.S. Provisional Patent Application No. 61/924,171 filed Jan. 6, 2014.

BACKGROUND

Field

This disclosure relates generally to the field of devices and methods for protecting biological tissues from traumatic injury. More particularly, this invention relates to constructs and devices tailored to protecting specific tissue types from common modes of injury, together with methods for achieving the same.

Description of the Related Art

Traumatic tissue injury, particularly traumatic injury due to direct and indirect impact with a tissue, is ubiquitous to human experience and can arise in the context of many work related and leisure activates. Specific industries exist for the development and provision of protective equipment for workers and for athletes, with the intent that the equipment will provide protection from events that could cause traumatic injuries, while ensuring that the worker or athlete remains fit to continue working or playing. But under some conditions, equipment can fail to prevent the traumatic injury, and due to design flaw, it may actually cause or exacerbate injury. Design flaws can exist for a variety of reasons, including fundamental misunderstanding about the mechanism of injury, and flawed approaches to testing that either fail to replicate the forces that cause injury, or fail to present the appropriate materials to represent the tissue to be protected, or fail to consider specific test conditions or testing equipment that may affect or skew the results relating to performance.

In large measure, most protective gear is generally adequate for protection against blunt trauma-inducing forces, such as direct linear impact with other athletes or objects. For example, helmets for various sports are generally acceptable for protecting the scalp and skull of the user from the liner impacts that are typical in the particular sport, with variations in density, thickness, and hardness of materials that are adapted for the specific sport. Thus, helmets for bicycling, on the one hand, and helmets for car and motorcycle racing (as well as for construction), on the other hand, vary from one another in the parameters of material density, thickness and hardness to reflect the relatively greater linear impact forces typical in the latter activities as compared with bicycling. Unfortunately, the adequacy of protectiveness of gear for tissue types other than the scalp and skull, quite importantly, the brain, and for other types of traumatizing forces, such as rotational forces (angular, non linear), is less reliable. Indeed, there is a great deal of evidence that sports and protective gear, particularly helmets, are tragically inadequate for protecting the brain from the most common and most damaging rotational forces.

The challenge of providing protective equipment in the team sports realm is complicated due to improvement in training athletes, which has led to bigger and stronger athletes, which in turn has led to proportionally increased forces upon impact. Media attention has revealed a very high incidence of significant long-term injury in a number of sports due to inadequate protection, particularly in the context of head injury. Thus, despite the very large industry for protective gear, and the seemingly high standards for gear testing, it is evident that improvements are needed both to the equipment and to the methods of testing.

Head and Brain Protection

The typical modes of injury to the head affect the facial bones, the skull and the brain, and are caused by linear and rotational forces that may be delivered directly or indirectly to the head and brain. For example, in the context of the head, a direct mechanical force involves direct impact with the head, such as when the head is struck by or strikes another object in a sport event or a vehicular accident. The other type of force does not necessarily involve direct contact with the head, and instead results when forces affect the head through movement in another part of the body. This indirect mechanical force translates through the body to the head and results in jerking, shaking or turning of the head, usually around the neck. In one example, brain injury can occur when a football player is struck hard by another player, indirectly delivering forces to the brain which are transmitted from the athlete's body through his/her neck. Other examples include a vehicular crash and the familiar resultant "whiplash," and instances of physical abuse such as beating and shaking. Additionally, small repetitive direct or indirect forces translated through the body to the head or directly to the tissue at magnitudes below the thresholds can still induce long-term injury to the tissue. In the brain, this is termed Chronic Traumatic Encephalopathy, which is caused by multiple traumatic and/or below traumatic injury thresholds due to repetitive accelerations of the head on impact, causing axonal damage (as seen in diffuse axonal injuries).

The direct and indirect forces typically comprise components of linear and rotational (or angular) acceleration, wherein linear forces act in a straight line relative to the brain, causing localized focal injury, while angular forces cause a rotation of the brain around its center of gravity, causing more diffuse and non-focal injury. For example, coup/contrecoup injury is typically thought of as being caused by the delivery of a blunt linear force. When the head either whips suddenly or is struck by an object with sufficient force, the "coup" injury occurs at the site of initial impact of the object or of the brain with the skull. The brain then bounces within the skull and the "contrecoup" injury occurs essentially on the opposite side of the brain from the coup injury.

Among the most severe brain injury, diffuse axonal injury ("DAI"), results from rotational forces that are experienced when the head rotates about the neck after an impact, and may represent the underlying mode of tissue damage in a coup/contrecoup injury. When angular/rotational forces affect the head, mechanical rotation of the head is translated to the brain which in turn rotates within the skull. Because of the internal shape of the skull and the anatomy of the brain, the translated rotational forces cause portions of the brain to move at different rates causing shearing within the brain tissue, leading to tearing of connective fibers, nerves and vasculature, and compression and compaction of these tissues. Diffuse axonal injuries can involve complex tissue and cellular damage, and associated swelling and bleeding that is diffuse and widespread, not focal, affecting parts of the brain that are distant from the site of actual or initial impact. In some severe cases, a subdural hematoma can develop in a relatively short time interval after the injury, which can lead to death or permanent disability. Diffuse axonal injury is one of the most common and devastating types of traumatic brain injury, and typically has long term and potentially devastating effects, though often the extent of the injury is not evident at or shortly after the time of the traumatic impact.

Protective equipment for the head is primarily in the form of a helmet that may or may not include a face guard component. Current protective gear is designed almost exclusively for sports such as football, hockey, and motor and cycling sports. The current devices have a wide variety of features and designs that are based upon an outer shield component layer and one or more interior layers, typically formed with padded material and may include other materials. Properly, these devices are designed for "single use only" since any concussive impact can weaken or deform the device beyond its threshold yield limit, such that it will not be protective in the instance of subsequent additional or repetitive hits. Practically, these devices are not treated as single use, at least in the consumer context, though it is increasingly the case that in sports such as football, particularly at the professional level, helmets are single use.

Whether single or multi use, conventional helmets and faceguards can provide acceptable protection against injuries caused by direct linear impact. An abundance of designs exist in the art that provide cushioning, with compressible foams such as expanded polystyrene, expanded polypropylene and/or with simple crush layers made from chambered polymeric or elastomeric materials. It is evident in the medical and scientific literature that injuries due to rotational forces are simply not addressed with conventional helmet designs. In one example, researchers at the Bioengineering Center at Wayne State University reported study results showing that a helmeted head sustains the same degree of angular acceleration as the un-helmeted head when subjected to identical impacts. Protective devices that stabilize the neck can help to minimize the damage caused by rotational forces, but for various reasons these stabilizing devices are not suitable for many activities and are typically not used in most sports, including football.

Improvements in the helmet art have attempted to address not only the linear but also rotational forces, and many examples of such improvements can be found in the technical and patent literature. The improvements include enhanced cushioning layers or enhanced crush layers that compress or deform upon impact, slip layers that allow some degree of variable movement of the helmet separate from the head (i.e., they slide over the wearers head), multipart helmet slip layers that move independently with rebound features and chambered compartment layers to counteract angular forces.

In one example of a helmet that is putatively improved to address angular forces, a multipart helmet includes viscoelastic material that facilitates slippage of the helmet components, and is identified by the inventor as being specifically directed to preventing rotational injury. The disclosed device includes an outer shell that surrounds at least a portion of the head, and is movable both radially and circumferentially relative to the head in response to an impact to the helmet. A liner is located between and attached to both the head and the outer shell and enables the outer shell to be fully returned to an initial relative position with the head cap following an impact to the helmet. The rationale for this design is the notion that the rotational acceleration forces can best be dissipated through the motion of the shell and the counter force that returns the shell components to their original position.

In another example of a helmet that is putatively designed to address rotational forces, a multipart helmet includes a hard outer shell and two or more inner liners, at least one of which has shock absorbing dampeners (air filled) and at least one of which binds to the dampener liner to suspend and control its movement. The two liners are coupled so that they can displace relative to each other "omnidirectionally," presumably in the direction of the force vectors, in response to both angular and translational forces from a glancing or direct blow to the hard outer shell of the helmet. The relative movement of the inner and outer layers or liners is controlled via various suspension, dampening, and motion controlling components that are disposed between the liners and couple them together for relative movement. In some embodiments, additional liners or partial liners can be inserted between the inner and outer liners and can comprise one or more of foam materials, such as multi- or single-density expanded polystyrene, expanded polypropylene, and expanded polyurethane.

In yet other examples in the art, helmets are taught that have at least three or more layers of polymeric and/or viscoelastic materials that are either free floating or interconnected. In some examples, the different layers have different sensitivities to pressure and can change state (from solid to flowable) upon impact such that the varied layers can react to and putatively counter or absorb potentially damaging forces. And yet other examples disclose slip layers that are interconnected such that upon impact the interconnections break allowing the interconnected layers to differentially slip to putatively counter or absorb potentially damaging forces.

While each of the above described examples of improvements in the helmet art provide features that are allegedly adapted to address rotational forces, the designs are deficient in that they rely on essentially one mode of energy dissipation that is either through shift and rebound of components, or dampened shifting of liners. As with the conventional helmet designs that rely primarily on a hard outer shell and thick semi-deformable pads and foam, these improved designs lack sufficient multimodal energy dissipative features that are designed to address the multitude of forces experienced in a particular activity. Further, the designs that provide rebound or unidirectional motion to absorb energy may further exacerbate injury or, at best, negate the energy dissipation that could be achieved if the materials did not rebound or rebound rapidly without significant delay.

Chest Protection

In addition to the brain, the chest and its soft tissues present another area that is very vulnerable to injury that could lead to catastrophic results. It is well known that Commotio cordis is a phenomenon in which a sudden blunt impact to the chest can result in sudden death due to ventricular fibrillation in the absence of cardiac damage. There are several critical thresholds that are exceeded when ventricular fibrillation is induced by blunt trauma, in particular with a ball impact. Studies have shown that if all variables currently known are maximized, approximately 30% of 30-mph impacts and 50% of 40-mph impacts will cause ventricular fibrillation in a 20-kg swine, (*Link M S,*

*Estes N A 3rd. Mechanically induced ventricular fibrillation (commotio cordis). Heart Rhythm.* 2007; 4:529-532)

It is the timing of the impact relative to the cardiac cycle that is a major culprit for commotio cordis risk, where only impacts on a narrow region on the upslope of the T wave of the cardiac cycle will cause ventricular fibrillation. Additionally, this phenomenon occurs in the absence of cardiac damage and is a result of direct impact to the chest that are above specific thresholds and impact speeds where the impact occurs during the upslope of the T wave. This is significantly different from a cardiac contusion (contusio cordis) scenario which is due to blunt chest trauma resulting in structural cardiac damage.

In sports, baseball has the highest incidence of commotio cordis due to direct baseball impact to the left chest wall over the cardiac silhouette. However, other sports such as hockey, lacrosse, and softball, for example, are experiencing increased occurrences and risks to this phenomenon where the sports have small rigid balls that can concentrate the stress over a smaller surface area to the cardiac silhouette. Additionally, Commotio cordis does occur from secondary injury related to impact with other individuals (elbows, fists, etc.) and equipment such as hockey, or lacrosse sticks, and helmets in other sports that do not involve direct impact from a small rigid ball or puck capable of concentrating significant force upon impact to a small focal area over the heart.

This disclosure addresses this gap by providing design rationale and performance and testing methods for validating the efficacy of protective gear, both generally, and specifically in the context of sports. This disclosure evolves from the point of view that the design of and means for testing protective equipment must draw upon materials science and an understanding of the vulnerabilities of the human physique to the damaging forces that are unique to a particular activity or sport. Accordingly, as described in greater detail below, in the exemplary embodiments and in variations on exemplary embodiments within the scope of the disclosure, provided herein are articles and protective gear and devices that include a combination of layers to achieve energy dissipation in multiple planes including translation (slip) as well as energy dissipation and absorption (crush) layers that provide resistance to linear impacts as well as rotational acceleration resistance and linear impact attenuation. While examples are provided herein for protecting the head and brain from axonal and other traumatic injury, and for protecting the chest from commotio cordis, the scope of the disclosure encompasses other tissues and body parts that can benefit from the designs and design rationale disclosed herein.

SUMMARY

This disclosure describes various exemplary composite components, devices and methods for achieving protection of biological tissues from traumatic injury.

Embodiments of the present invention include composite component layers, and devices that comprise combinations of component layers that are adapted for protection against various types of impact-induced trauma and indirect acceleration induced injuries. In some specific embodiments, the devices comprise specific composite component layer combinations tailored to specific tissue types to protect against modes of traumatic injury that are specific to the tissue type.

In various combinations, the composite components provided herein include two or more of any of the following, in various combinations and in various orders:

one or more shield component layers that is relatively thin and rigid with selected thickness, hardness and brittleness; in some embodiments this layer is referred to as a resilient outer shell;

one or more slip component layers of selected thickness and materials comprised of a flowable material, such as but not limited to a gel or gel like material, having viscoelastic properties and is soft and deformable;

one or more crush component layers that is of selected thickness and that has a plurality of chambers that may be unfilled, filled, or mix filled, is deformable, and comprises one or combinations of semi-rigid and rigid structures selected from corrugations, trusses, struts, honeycombs, channels, and cells, all, some or none of which may be interconnected and which are formed of selected materials with selected dimensional properties that reflect energy dissipative capacity on at least one plane or across a surface area such as a curved shape that would conform to at least a portion of a skull or other body part to be protected;

one or more contact friction mitigating component layers that is relatively thin and rigid with selected surface properties including a low coefficient of friction; such contact friction mitigation components may be separate from or integral with and comprise a surface on a shield component layer or shell; and one or more break-away component layers that releasably binds two adjacent layers.

In various embodiments, the two or more component layers may be combined to provide protection to any of a variety of body parts, including but not limited to: the head for protection of one or more of the face, skull, and brain; neck; chest; elbows; knees; abdomen; pelvis/groin; legs; and feet. The general rationale for layer selection, as provided herein below addresses, in some exemplary embodiments, protection of the head and particularly the brain. In the various embodiments for protecting tissues, layer selection includes consideration of the common modes of injury associated with a particular activity (such as impact with a ball in baseball vs. impact with the ground or another player in football) and the energy dissipative features that would mitigate injury informs the selection of the component layers for a particular tissue and activity.

In one exemplary embodiment, the present disclosure provides a device comprising a combination of composite components that are layered to provide a protective helmet having an outer surface and an interior for receiving a user's head. The representative helmet comprises, in various embodiments, at least three component layers comprising an outer shield component layer, an intermediate slip component layer and a crush component layer.

In other embodiments, methods are provided for designing programmed protective devices comprising composite component layers and arrangements thereof having energy dissipative capacities that are specifically tailored to one or more of a particular tissue type to be protected, a particular activity or sport, a particular demographic of user, and a particular individual.

This disclosure also describes methods of testing for relevant failure modes of protective gear that correlate with actual modes of tissue injury, and methods for verifying the suitability of the component layers and devices to achieve the intended protection.

BRIEF DESCRIPTION OF THE DRAWINGS

The patent file contains at least one drawing executed in color. Copies of this patent with color drawing(s) will be provided by the Patent and Trademark Office upon request and payment of the necessary fee.

Features and advantages of the general inventive concepts will become apparent from the following description made with reference to the accompanying drawings, including drawings represented herein in the attached set of figures, of which the following is a brief description.

DETAILED DESCRIPTION

Figure 1:
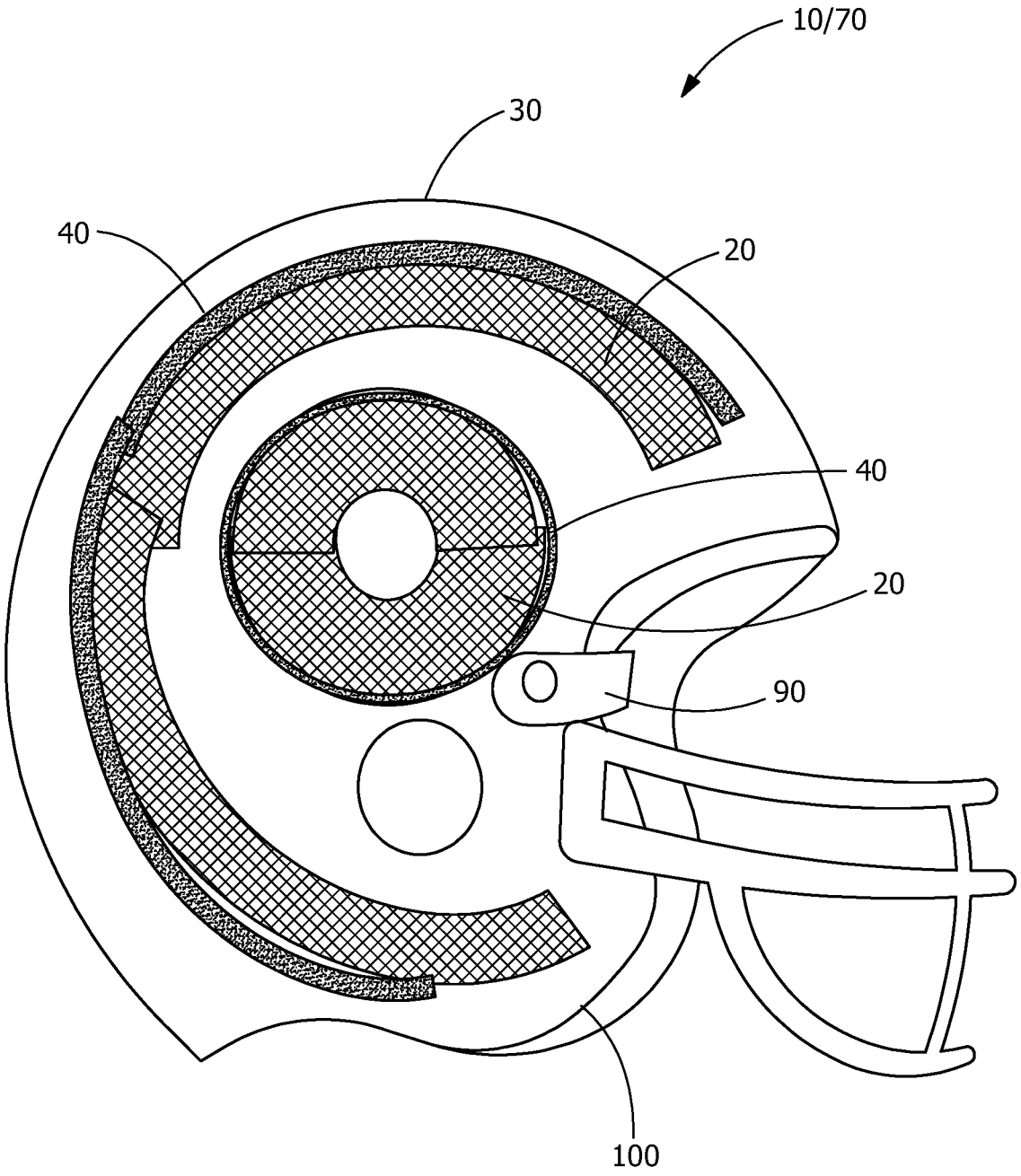
FIG. 1 shows a representative embodiment of protective gear in accordance with the disclosure, the gear comprising a protective helmet having a conventional helmet profile for football.

The general inventive concepts will now be described with occasional reference to the exemplary embodiments of the invention. It should be understood that this disclosure merely describes exemplary embodiments in accordance with the general inventive concepts and is not intended to limit the scope of the invention in any way. Indeed, the invention as described in the specification is broader than and unlimited by the exemplary embodiments set forth herein, and the terms used herein have their full ordinary meaning.

Unless otherwise defined, all technical and scientific terms used herein have the same meaning as commonly understood by one of ordinary skill in the art encompassing the general inventive concepts. The terminology set forth in this detailed description is for describing particular embodiments only and is not intended to be limiting of the general inventive concepts. As used in this detailed description, the singular forms "a," "an," and "the" are intended to include the plural forms as well, unless the context clearly indicates otherwise.

Unless otherwise indicated, all numbers expressing numerical ranges, and so forth as used in the specification are to be understood as being modified in all instances by the term "about." Accordingly, unless otherwise indicated, the numerical properties set forth in the specification are approximations that may vary depending on the suitable properties sought to be obtained in embodiments of the present invention. Notwithstanding that the numerical ranges and parameters setting forth the broad scope of the general inventive concepts are approximations, the numerical values set forth in the specific examples are reported as precisely as possible. Any numerical values, however, inherently contain certain errors necessarily resulting from error found in their respective measurements.

Rationale for Protective Gear

Disclosed herein is a general design rationale for protective gear, including in connection with exemplary embodiments, a specific rationale for headgear. In the context of the exemplary embodiments, the rationale addresses both linear and rotational injury caused by direct and indirect impact between the protected tissue and an object by providing multimodal energy dissipation. The inventor has recognized that the failure of conventional and improved equipment to protect against rotational injury derives from a inability of the devices to increase the impact stimulus time to further dissipate energy/force away from the tissue, for example the brain.

Key to the design rationale is the provision of multiple component layers that can perform independently, and in some embodiments act at least additively, using multiple modes of energy dissipation, to substantially increase the impact stimulus time for the acceleration and maximize the dissipation of energy from the instant of impact.

The rationale includes selection from multiple component layer materials that provide a variable response rate based on the load rate at impact. Such component layer materials act together, in some embodiments in additive fashion, some layers performing like linear springs that are deformable and may deform permanently given sufficient impact load. Some component layers achieve dissipation of impact energy through motion dampening through flowable slippage and crushing or collapsing. The energy dissipation is further enhanced in some embodiments through use of component layers that minimize friction between the protective gear outer surface and the impact surface, and that minimize friction between the wearer's body part and the interior of gear and the layers there between.

In contrast to many multi use devices, in some embodiments the multimodal devices of the instant disclosure, particularly helmets, are intended and designed for single use and are intended to be discarded after use due to the mechanical effects of stress forces on their components and in some instances permanent deformation. Of course, in alternate embodiments, the devices are designed to be multiple use except in the event of impacts that cause crush failure or otherwise destructive compromise of any of the composite layers. And in some embodiments, the devices include any of a variety of sensors and corresponding indicators to evidence the extent of compromise of any of the composite layers. According to such embodiments, the sensor and indicators may be directly visualized, or may be telemetric.

In the case of protective gear for the head, the combined energy dissipation modes can be tailored to minimize and possibly prevent one or both linear and rotational motion of the brain within the skull, as well as repetitive trauma stimuli. Indeed, it is well known that repetitive hits over a course of weeks, years, and months, each of which may be below threshold for acute tissue injury, can and do have cumulative effects that can lead to long term damage and significant morbidity and in some cases mortality. In the case of the brain, chronic traumatic encephalopathy arises from these accumulated impacts, and is responsible for long term, and often, catastrophic diffuse axonal injury and associated loss of function or death. Sports such as football, as well as other heavy contact activities, are examples where body impacts and resultant neck motion can cause brain rotations repeatedly through a season of practice and games, causing long term detrimental effects despite the fact that no single traumatic injury was sustained over the time period. Helmets having the layered design according to the instant disclosure, particularly embodiments comprising one or more slip layers and at least one crush component layer, would be suited for multiple uses to protect against cumulative injury, with optional supplemental layers to provide additional protection against destructive direct impacts to the gear itself. In that regard, in some embodiments, modular gear systems may be designed that would include reusable inserts comprising slip and crush layer composites that inter-fit in a modular fashion with helmet constructs that includes a resilient outer shell, and additional layers that are particularly adapted for dissipating the energy from direct destructive liner and angular impacts.

Ultimately, in the context of protective gear, particularly helmets, the design rationale enables extension of the time and the effective surface area to delay and dissipate energy that would otherwise confer motion to the brain such that the protective gear will thereby attenuate rotational forces that would cause severe brain injury, as well as linear forces that would cause focal injury to the brain, particularly the discrete instances of trauma the repetition of which, over time leads to injury.

Rationale for Composite Component Selection and Design

The design rationale address the approaches for achieving the inventions as described herein, and generally contemplates: the specific type of tissue to be protected; the nature of the current state-of-the-art protective equipment; the modes of traumatic injury specific to the tissue; and, the known failure modes of current protective equipment. The rationale provides, in various embodiments, the features and performance parameters for protective equipment that will counter the forces typically encountered in an activity and will overcome the common modes of failure of known prior art protective gear. Thus, the rationale accounts for the nature of the tissue to be protected based on the modes of traumatic injury typically experienced by the tissue, the forces that are typically encountered by that tissue in the sport or activity, the demographic of the athlete/participant that may impact the magnitude of the experienced forces, and the current state-of-the-art protective equipment and the modes of failure of the equipment that make the tissue vulnerable to the typical modes of injury.

In various combinations, the composite components provided herein include two or more of any of the following in various combinations and in various orders:

- one or more shield component layers that is relatively thin and rigid with selected thickness, hardness and brittleness;
- one or more crush component layers that is of selected thickness that has a plurality of chambers that may be unfilled, filled, or mix filled, is deformable, and comprises one or combinations of structures selected from corrugations, trusses, struts, honeycombs, channels, and cells, all, some or none of which may be interconnected;
- one or more slip component layers of selected thickness comprised of a flowable material, such as but not limited to a gel or gel like material, having viscoelastic properties and is soft and deformable;
- one or more contact friction mitigating component layers that is relatively thin and rigid with selected surface properties including a low coefficient of friction; and
- one or more break-away component layers that releasably binds two adjacent layers to provide additional delay in energy transmission.

Representative Embodiment of Protective Gear

In various embodiments, protective gear and subcomponents thereof are provided herein to confer a protective effect with respect to linear and angular/rotational forces that are directed to a body part that can be injured either through impact with an object such as a ball or sports implement, or through contact with another athlete, or with an inanimate object or surface. In some embodiments, helmets are provided, and in particular, some embodiments of helmets are provided to confer a protective effect with respect to linear and angular/rotational forces that are directed to the body of the wearer, and not directly to the head wherein the energy from these impacts is directed through the wearer's neck to the head resulting in shaking or whipping and attendant injury to the brain as described in the literature and referenced herein above. Thus, according to certain embodiments of head protective gear, a helmet is adapted with features to ensure a close fit between the gear and the wearer to thereby maximize the energy dissipative benefit of the layers to offset and disperse the energy that would otherwise be absorbed by the wearers scalp, skull and brain. Exemplary embodiments of helmets, and the designed energy dissipative properties thereof are described in further detail herein below.

Figure 2:
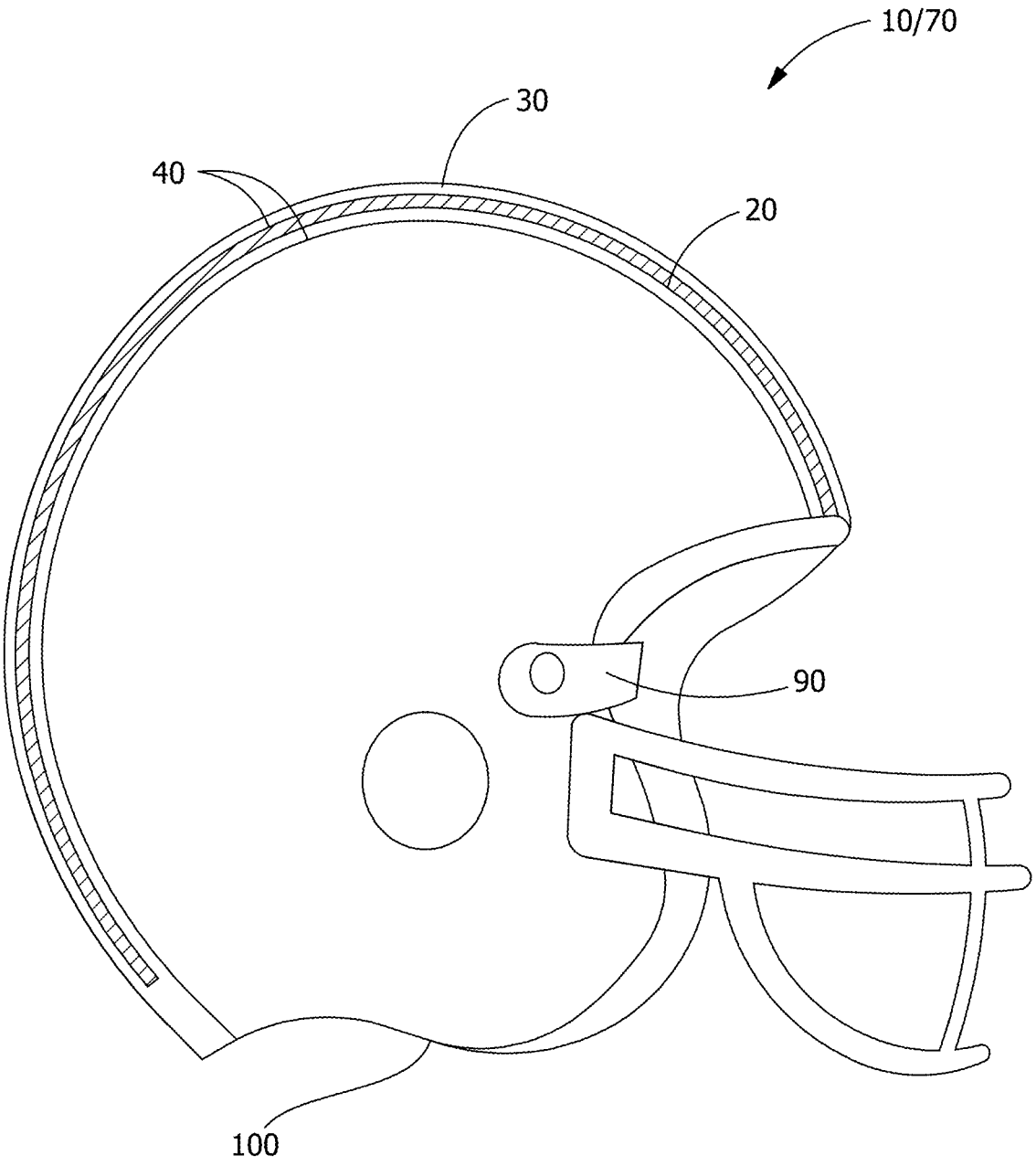
FIG. 2 shows an alternate view of the protective helmet of FIG. 1, in cross section.

Referring now to the drawings, FIG. 1 shows a representative example of an embodiment of protective gear comprising protective component layers in accordance with the disclosure. FIG. 2 shows an alternate view of the protective gear in FIG. 1, in cross section. The depicted gear in both drawings is a helmet having the general configuration of a prior art football athletic helmet, with a frame consisting of various layers for encasing the wearer's head, and a faceguard. As with the prior art, the depicted helmet in FIG. 1 and FIG. 2 includes an outer shell and interior layers that in the prior art would typically comprise pads or filled bladders that hold air or fluid. Referring again to FIG. 1 and FIG. 2, as shown, the exemplary embodiment of a helmet according to the disclosure comprises a resilient outer shell component layer (RSL) 30 in the form of a resilient hard shell. The hard shell includes, in exemplary embodiments, a surface with a low coefficient of friction that allows sliding along most surfaces that it may contact to increase the acceleration duration. Such coating may be applied hard shell or may be a characteristic of the shell material.

Figure 4:
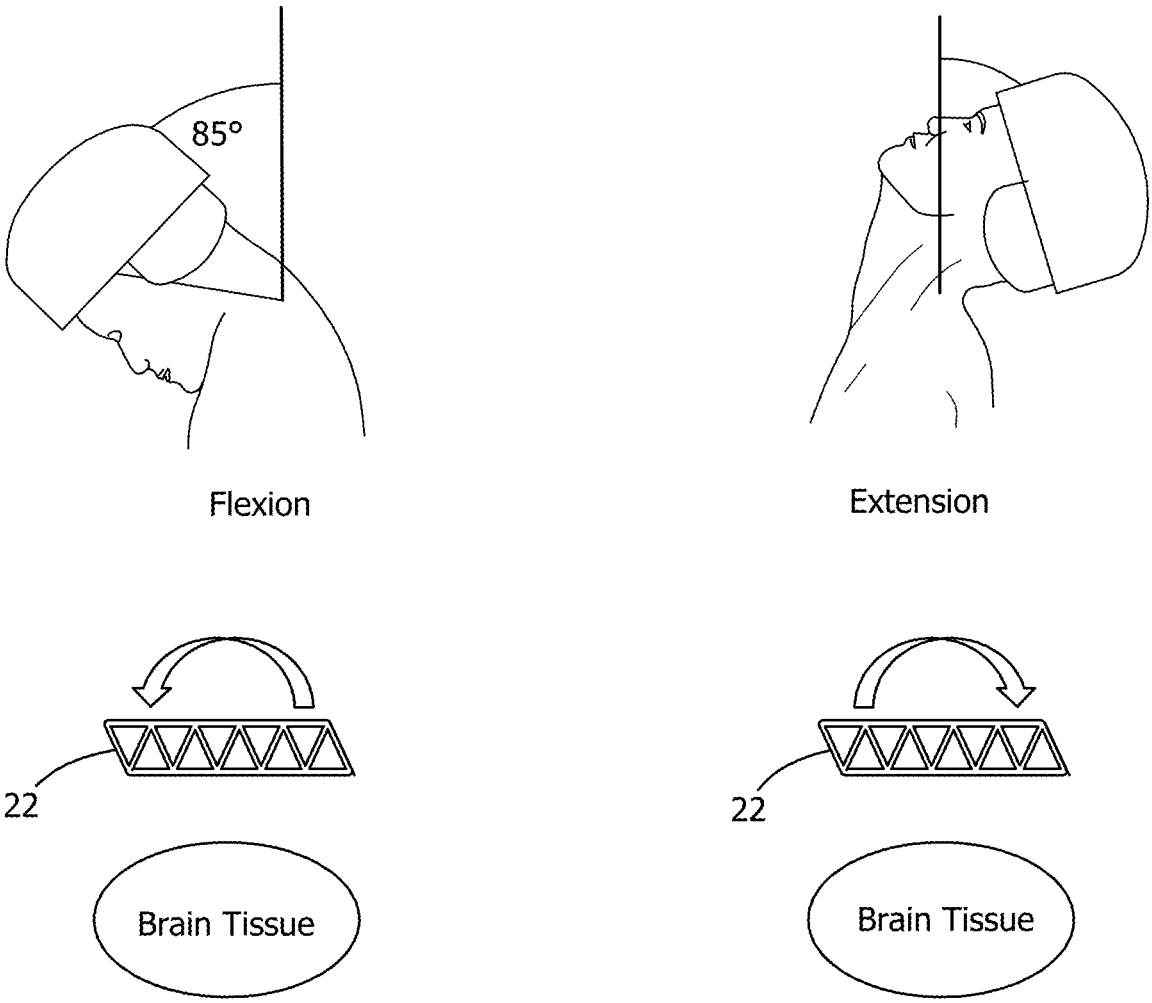
FIG. 4 shows a schematic depicting a helmeted head in motion with forward flexion and with rearward extension, and corresponding graphics indicating the relative motion of a crush layer component according to the disclosure.

Referring again to FIG. 1 and FIG. 2, the depicted helmet 70 further comprises at least a first slip component layer (SL) 40, wherein in some embodiments the slip component layer 40 is oriented on a surface adjacent to the interior wall of the hard shell layer 30. In some exemplary embodiments, the slip component layer 40 also has a low coefficient of friction, and is adjacent with the hard shell layer 30 on one side and has a crush component layer 20 on its other side, and is either mechanically dissociated from or mechanically connected to one or both the shell and crush component layers 30, 20. The slip component layer 40 allows relative sliding between the shell and the crush layers 30, 20, to delay or increase deceleration time of force to the brain after impact as the head rotates about the neck, for example as shown in FIG. 4. In some embodiments, the slip component layer 40 is a solid that is deformable, or phase changing or both, or comprises a sack filled with material that is selected from a deformable solid or semi solid, phase changing, and low friction non-Newtonian fluid, wherein the outer sack has a low coefficient of friction.

The depicted helmet 70 also comprises a crush component layer (CL) 20. Various configurations selected from truss structures 22, honeycomb 24, and other open cell structures may be used, characteristics of which can be programmed through geometry, cell configuration, truss strut configuration, strut dimensions, strut orientations and angles (for example), fill and material selection, and combinations of these, to control, predict, design, combine, and vary force magnitudes, energy absorption, and directional concentrations of force, for different skill sets, ages, body sizes, (pediatric vs. adult, professional vs. college, expert vs. amateur). And as shown, the depicted helmet 70 comprises an inner slip component layer 40. In the depicted embodiment, the inner slip component layer 40 and the outer slip component layer 40 are in contact with but not mechanically connected to the adjacent layers, though such connection may be used in alternate embodiments. The slip component layer 40 comprises material having a low coefficient of friction, and as with the outer slip component layer, allows relative sliding between the shell and the crush layers 30, 20, to delay or increase deceleration time of force to the brain after impact as the head rotates about the neck. In some embodiments, the slip component layer 40 is a solid that is deformable, or phase changing or both, or comprises a sack filled with material that is selected from a deformable solid or semi solid, phase changing, and low friction non-Newtonian fluid, wherein the outer sack has a low coefficient of friction.

Figure 3:
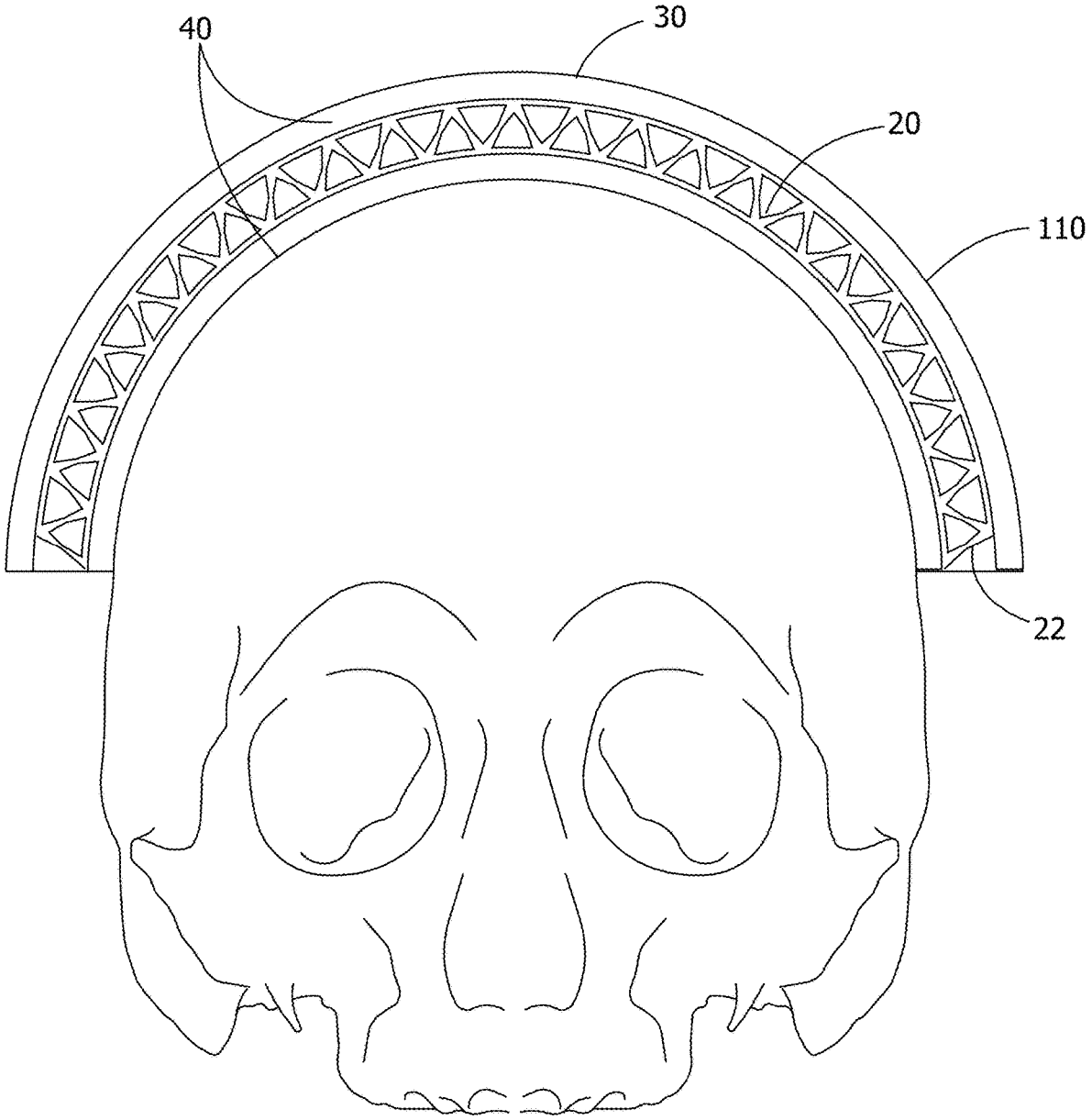
FIG. 3 is a rough schematic showing a portion of an assembly of component layers of the exemplary embodiment as shown in the previous drawings, positioned on a portion of a skull.
Figure 5:
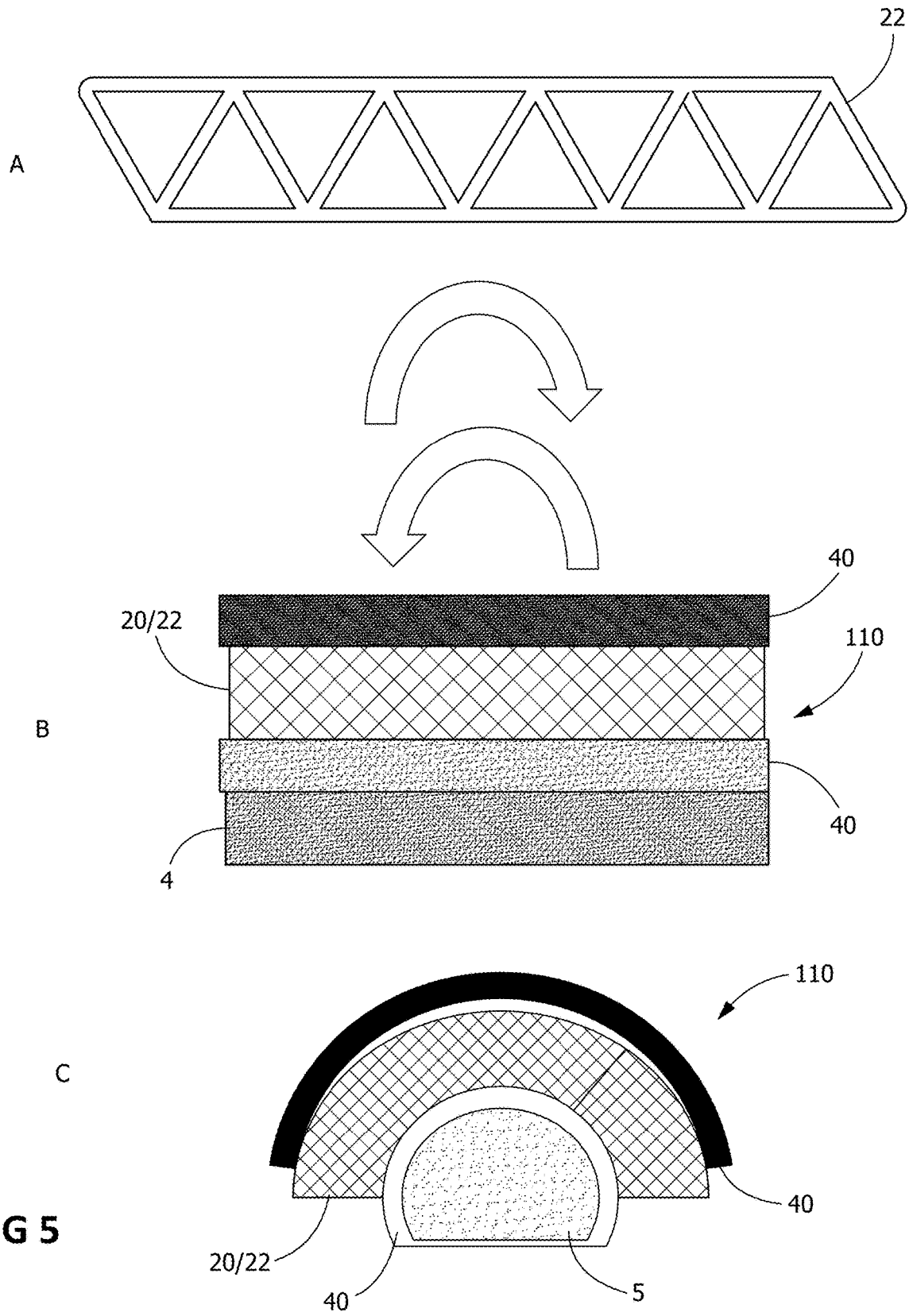
FIG. 5 shows a schematic indicating further detail of the schematic of FIG. 4, showing in Panel A a simple truss that is the basis of a truss assembly in an embodiment of a crush component layer, and showing in Panel B detail of a layered composite according to the disclosure comprising first and second slip layers sandwiching a crush layer, the second slip layer adjacent to skin 4, and showing in Panel C a cutaway view of the representative composite in Panel B positioned on the crown of a representative head form 5.
Figure 6:
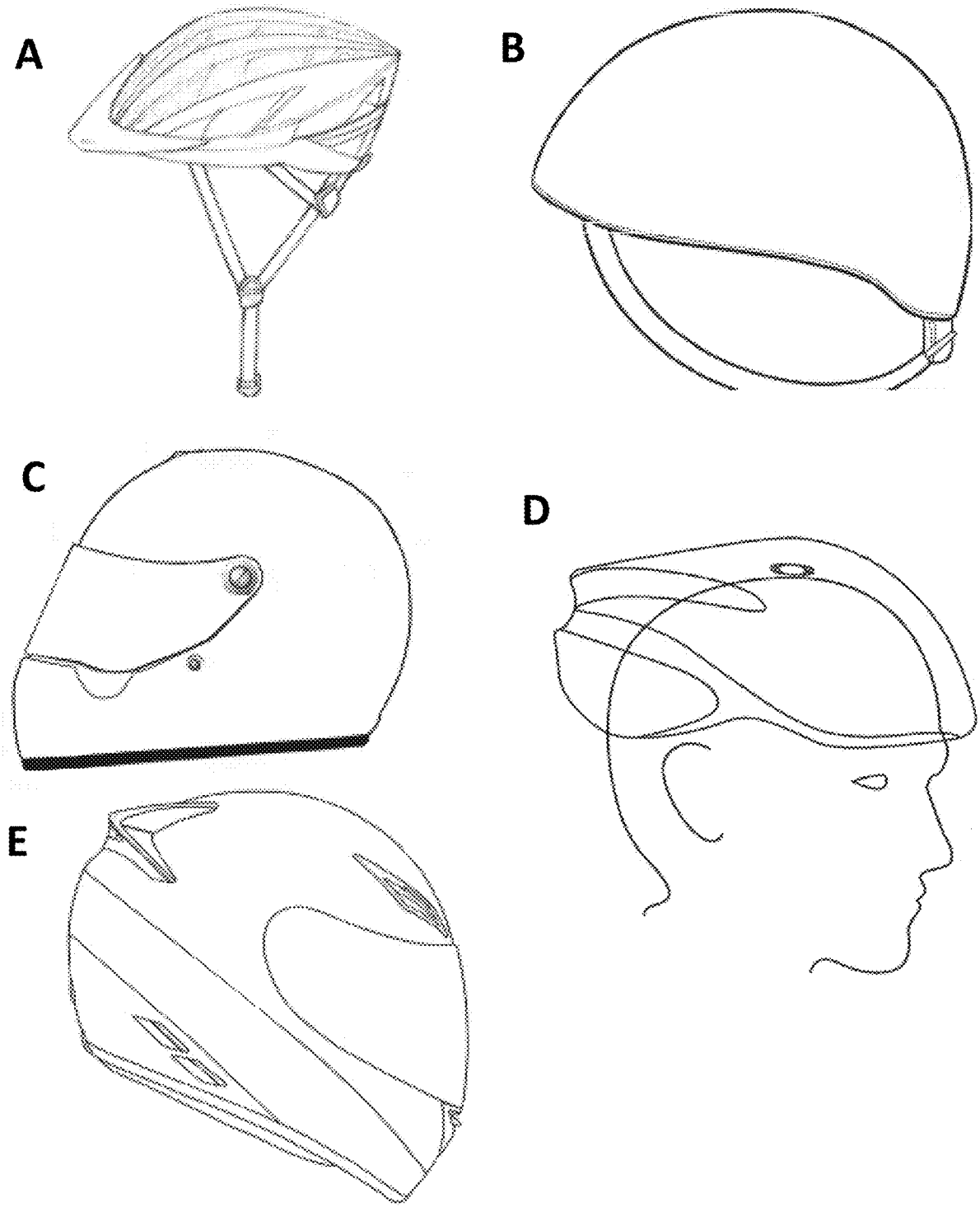
FIG 6 (PRIOR ART)
FIG. 6A-E shows examples of different types of prior art helmets for cycling sports.

Referring again to the drawings, FIG. 3 is a rough schematic showing a portion of an assembly 110 of component layers of the exemplary embodiment as shown in the previous drawings, positioned on a portion of a skull. FIG. 5 shows a variation on the layered assembly 110 of FIG. 3, also comprising slip component layers 40 sandwiching a crush component layer 20, and indicating the relative motion of the layers with respect to the head in the instance of head motion caused by direct or indirect impact. The depicted layers include outer and inner slip component layers (SL) 40 and a representative crush component layer 20 having a truss configuration 22 (CL). It will be appreciated that in use, the protective article 10 is formed to provide close contact with and coverage of a portion of the tissue or body part to be protected, in accordance with designs that are generally accepted in the applicable art. Thus, in the case of helmets, the profile of the article would be generally as shown in FIG. 1, or alternatively for other sports such as cycling, the article would be configured for example according to one of the prior art helmet designs shown in FIG. 6.

In the various possible helmet configurations, the component layers would cover at least a portion or portions of the wearer's head, and in some embodiments, the layers would be substantially contiguous with the entire interior surface of the protective article. Further description of the orientation, shape, coverage and other configurations of component layers in protective gear is provided in greater detail herein. While this representative example of protective gear according to the disclosure is a helmet, it will be appreciated that the problems to be solved and the variations in design with respect to the various layers and their properties can be readily adapted to protection of body parts and tissue other than the head and brain, such as gear for protecting the chest, elbows, and shins, and that such other embodiments of protective gear would likewise be substantially contiguous with the surface of the area to be protected and the composite layers therein would be contiguous with or otherwise distributed in segments over the area to be protected.

Component Layers

A variety of possible component layers will now be described, with examples of features and material options for each of the layers. It will be understood by one of ordinary skill that elements and materials from various component layers may be combined or integrated into a single layer to provide multimodal functionality in a single layer.

Resilient Shield Component Layers

In some embodiments, a shield component layer is used where the protected body part is vulnerable to contact or direct impact with another object, particularly hard and/or dense objects that may be contacted at a relatively high speed. Examples of such contact include impact with a moving baseball, impact between the helmets or other articles worn by hockey or football players, and impact with the ground or other structure as may be experienced by a knee, elbow or wrist, or head in a cycling or vehicular crash.

In various embodiments, a shield component layer forms an energy absorbing resilient outer shell. In some embodiments, the shield component layer is thin, lightweight and structurally rigid, and in some embodiments has an outer surface with a low coefficient of friction (from less than to approximately equal to the coefficient of friction of ice at 0 degrees C.). The shield component material has one or more of the features of rigidity, hardness and brittleness selected for initially receiving and resisting impact, and may in some embodiments elastically deform prior to fracture or other destructive deformation. According to some embodiments, due to a low friction surface, the shield layer is capable of and allows for slipping (sliding). A particular example of a protective article having a shield component layer that is slippery or lubricious is a protective helmet, wherein the low friction surface functions to initially influence deceleration of the brain by increasing the acceleration and deceleration duration. A key aspect of the shield component layer is to present an initial energy dissipative function that will deflect the impacting object, and absorb a portion of the impact energy through elastic deformation of the shield layer or rupture, crush, or other destructive deformation of the shield layer. Examples of material used for the shield component include, but are not limited to: relatively hard materials, such as polycarbonate and poly(acrylonitrile butadiene-styrene) (ABS), as well as relatively rigid but flexible materials selected from flexible thermoplastic composites comprising fibers selected from glass, carbon, nanomaterials, metals and combinations of these.

In various embodiments the shield component layer has a thickness, selected in part based on the nature of impact forces likely to be encountered by the protective article, and has an essentially uniform and smooth outer surface. In some embodiments, the shield layer is of continuous thickness and density and forms a shell. In other embodiments, the shield layer is smooth on the outside but varies in one or more of thickness, density, and structure. Thus, in some embodiments, the shield component layer may comprise one or combinations of structures selected from corrugations, trusses, struts, honeycombs, channels, and cells, all, some or none of which may be interconnected and all or some of which may be filled. In various embodiments, the shield component layer is continuous or discontinuous in its contact with one or more adjacent layers.

Crush Component Layers

The term "crush layer" means and includes a layer for use in protective gear formed of a material having any open architectural structure, selected from, for example, a simple truss design and a honeycomb, that absorbs energy by converting the impact force to compression across the structure. The resistant force of the crush structure depends on total area of structure exposed to impact load, therefore, a larger cross-sectional area translates to a larger resistant force for a given deformation. Crush component layers are provided to function as mechanical energy dissipaters through the recoverable or destructive deformation of one or more crush elements. As used herein, a crush element is a structure that is adapted for deformation at a selected breaking threshold to dissipate one or both indirect (vibrational) and impact energy, including for example, compressive forces, compressive shear forces, and torsional forces. In various embodiments, the crush component layer is crushably deformable. In some specific embodiments, the deformation includes fracture or breakage of one or more elements of the crush component layer.

In some embodiments, the crush layer is comprised at least in part of truss structures. As used herein, the term "truss" means and refers to a supporting structure or framework composed of beams interconnected in a single plane to form at least a simple triangle or rectangle (simple truss) which includes one or more braces (also referred to as "struts"). In some embodiments, a truss may be complex. A wide variety of simple and complex trusses are well known in the engineering arts and the terms "simple" and "complex" as used herein in association with trusses are intended to be consistent therewith. As used herein, the term "truss assembly" refers to an assembly wherein multiple trusses are organized into multi-planar structures that may have two, three, four, five, six or more sides. In some embodiments, trusses assemblies may comprise two or more different trusses, and the trusses may be arranged to form a three dimensional multi-planar structure with one more trusses transecting within the three dimensional structure. Truss assemblies may be further combined into "truss arrays" which term refers to arrays of two or more truss assemblies. Truss arrays may comprise combinations of the same or of varying truss assemblies. Truss arrays may include truss assemblies that are not connected, and assemblies that are interconnected, and combinations of these, any interconnections being formed with braces, trusses, and other structures and combinations of these.

Trusses, truss assemblies, and truss arrays can be programmed (i.e., designed) for different force stimuli and energy dissipative characteristics. Various combinational configurations, geometries, and dimensions of trusses can be specifically configured to provide energy dissipative protection to match the forces that are encountered in different activities, such as sports. These trusses, when combined in assemblies and arrays, alone or together with different numbers and types of slip layers can be specifically developed to differentiate protective equipment for different sports, age levels, sizes, and skill levels. More generally, in some embodiments, the material of a crush element is selected for its breaking threshold. In some embodiments, the breaking threshold of a crush element is engineered though the use of one or more of material selection, strut girth, and notches or other strategically placed break points. In some specific embodiments, the crush layer is engineered to deform and ultimately crush when preset force loads are applied, thus enabling a protective device to be programmed for a particular activity or sport wherein the types and magnitudes are forces are well understood and described in the scientific literature and whereby the devices can be specifically programmed for tailored protection of a wearer selected from one or more of weight, size and age. Thus, in one example, protective devices may be provided with crush layers that are adapted to protect against forces that are typically experienced in junior (pediatric) football player populations, with gear size and weight optimized to the pediatric population. And, the same type of protective gear may be adapted to protect against the typically greater forces that are experienced in an adult population, taking advantage of the greater size and weight options for gear designed to fit an adult.

Provided herein are examples of crush elements in the form of truss assemblies that have been analyzed using validated finite element analysis techniques for their ability to absorb and disperse stresses upon the application of linear (compressive), shear, and torsional (compressive with shear) force loads. As described in more detail herein below, the representative FEA data show that crush layers, such as, for example, honeycombs and trusses and truss assemblies, can be engineered to provide tailored stress absorption at preselected thresholds, and that such truss assemblies can be used in providing protective gear that is tailored to deliver protective benefit to tissue. One of ordinary skill will appreciate that the selection of crush elements, such as truss structures, is not intended to be limiting in any way to those crush elements comprising truss structures, as described in connection with the examples and representative embodiments herein.

In the various embodiments, the crush component layer has a plurality of chambers that may be unfilled, filled, or mix filled, and the shape, pattern, and distribution of the chambers may be regular, irregular/random, varying, or mixed. In some embodiments, the crush component layer comprises chambers all or some of which are fully or at least partially filled. In some embodiments, all or a portion of crush elements may be formed of a material that is regenerable or healing, such that minor breaks and crushing may recover through elastomeric or chemical regeneration, and may be uniform or non-uniform within the same structure with respect to design and materials (different cell and wall/strut thickness, materials, densities, etc.) and mix truss with honeycomb structures, for example. A crush component layer may be continuous or discontinuous with adjacent layers. In one example wherein the protective article comprising component layers is a helmet, a crush layer is situated between an outer shield component layer and the user's head, with or without possible intervening layers such as one or more slip layers, and the crush component is selected from a structural form and having a fill profile to allow energy from impact to be absorbed and dampened through the fill and crushing or crumpling of the form, which together function to absorb and deflect energy so as to reduce rotational energy to prevent or slow brain motion within the skull. In various embodiments the crush component layer has a thickness that varies based on consideration of the tissue to be protected and the desirable fit and size features of the protective gear into which the layer is incorporated.

In some embodiments, a crush component layer comprises one or both of minor (smaller dimensioned) and major (larger dimensioned) crush elements, wherein the range of smaller and larger dimensions include one or combinations of height, width, depth, thickness, wall thickness, and cell size. In some such embodiments, there may be a series of differently shaped or sized crush elements ranging from minor to one or more intermediate to major. In some embodiments, any of the one or more crush elements are multi-planar, that is, there are multiple orientations of crush elements. When two or more of minor, intermediate and major crush elements are present in a crush component layer, the crush elements may vary in any one or more of shape, orientation, dimensions, distribution, frequency, material of manufacture, and structure.

In some embodiments, multiple layers of a composite according to the disclosure may be prepared, in a continuous or discontinuous manner. Thus, in some embodiments, adjacent layers of slip components and crush components and resilient shell components may be manufactured by additive means, wherein the materials may be the same or may vary between the layers and the interfaces may be continuous or discontinuous.

In some embodiments, crush elements of the component layers may be prepared at least in part by additive manufacturing. Thus, in some such embodiments, various layers of crush elements of varying dimensions and varying materials may be prepared in a continuous manner or a discontinuous manner, thereby avoiding in some instances the requirement of attaching and arranging the arrays as would be needed in the instance of reductive or other manufacturing.

Of course, it will be appreciated that the method of manufacturing of a crush element or crush component layer, as well as any other component layer is not in any way intended to be limiting. Methods of standard manufacture of various component materials are well known in the art. As may be described herein in terms of specific exemplary embodiments, some modes of manufacture may be desirable, but except as may be expressly stated herein, they are not intended to be limiting or to exclude other methods of manufacture that are or may become common in the art.

Slip Component Layers

Slip component layers are provided to deliver energy absorption/dissipation through one or more of slipping and passage of layers over and past one another, cushioning, and elastic and/or viscoelastic deformation. In various embodiments, a first slip component layer is situated between the outer resilient shield component layer and the tissue to be protected, and in some embodiments may be positioned at one or more locations between intervening layers as described herein. The slip component layer comprises one or more lubricious slip components, provided in a matrix, or free flowing, or in sections or bladders, or combinations of these. A slip layer may be continuous or discontinuous with adjacent layers. Thus, in some embodiments, a slip layer may have a comparable overall surface area as compared with one or more adjacent layers. In other embodiments, a slip layer may cover only a portion of the surface area that is covered by any one or more adjacent layers. Thus, in some such embodiments, while one layer may continuously cover a particular surface or have a particular overall surface area, one or more other layers may be discontinuous and cover only select portions of the same surface area.

A slip layer may include one or more components of selected viscosities. In some embodiments, a slip component may include a fluid whose viscosity can be modulated to attenuate its viscosity, deformation and flow features, such as by temperature, magnetism, or electrical charge, for example a fluid which is ferro-fluidic, or piezoelectric, Newtonian or non-Newtonian, or thixotropic. A fluid can be either Newtonian, wherein the relationship between its stress versus strain is linear and the constant of proportionality is known as the viscosity, or it can be non-Newtonian, wherein the relation between its shear stress and the shear rate is different, and can be time-dependent and for which there is not a constant coefficient of viscosity.

The slip layer may include materials such as thixotropic materials that are load rate responsive and exhibit viscoelastic behavior to provide energy dissipation and vibrational dampening. In some embodiments, the fluid is a gel. In other embodiments, the slip component is selected from flowable fluid-like materials such as powders, beads and other solids. In yet other embodiments, slip layers may comprise combinations of solid, gel and liquid components which may be mixed or which may be discretely contained and either layered or positioned adjacently on a surface. Slip component layer in some embodiments provide an elastic cushion layer that is soft and deformable. In some embodiments, the slip component layer comprises one or combinations of structures selected from corrugations, trusses, struts, honeycombs, channels, and cells, all, some or none of which may be interconnected. In various embodiments the slip component layer has a thickness that varies based on consideration of the nature of the tissue to be protected, the degree of protective effect sought to be delivered by the layer, and the desirable fit and size features of the protective gear into which it is incorporated.

Contact Friction Mitigating Layer

Contact friction mitigating component layers are provided for protective articles used in instances where the protected body part is vulnerable to contact or direct impact with another object, particularly hard and/or dense objects that may be contacted at a relatively high speed. The principle function of the layer is to provide a highly lubricious contact surface that will tend to facilitate sliding of the protective article relative to the impacted object to minimize rotation and twisting due to friction.

In various embodiments the lubricity of the contact friction mitigating component layer is achieved using lubricious polymers, such as but not limited to: polyethylene oxide (PEO), polyethylene glycol (PEG), polyvinyl pyrrolidone (PVP), and polyurethane (PU). Other lubricious materials that may be selected include carbon based materials such as graphene, graphite, diamonds or nanodiamonds or diamond like films. Yet other lubricious materials known in the art may be selected. Application of the materials may be achieved by means such as dip coating, spray coating, and other coating means known generally in the art.

In some embodiments, the contact friction mitigating layer is a thin shell or film on the exterior of the protective article, or incorporated with or adjacent to another layer, such as an resilient outer shell, or a slip layer, or a crush layer, for example. In some embodiments, the layer is formed as an outer layer or coating on the surface of a shield component layer. In the various embodiments, the thickness, wear properties, lubricity and other features of the contact friction mitigating material are selected based on the nature of the protective article.

Break-Away Component Layers

In some embodiments, break-away component layers are provided to releasably bind two adjacent layers, which may in some embodiments provide additional delay and attenuation of energy transmission towards the tissue to be protected.

Thus, in some embodiments at least a first break away layer releasably binds two adjacent layers to provide additional delay in energy transmission to supplement or compliment the energy dispersion provided by one or more of shield, contact friction mitigating, slip and crush layers, each break away layer comprising breakable trusses, struts, dampeners or tethers that are adapted to break away upon achieving a predetermined force threshold.

In various embodiments the break-away component layer has a thickness that varies based on consideration of the nature of the tissue to be protected, the degree of protective effect sought to be delivered by the layer, and the desirable fit and size features of the protective gear into which it is incorporated. In various embodiments, the break-away component layer is continuous or discontinuous in its contact with adjacent layers. In various embodiments, the break-away component layer comprises one or combinations of structures selected from corrugations, trusses, struts, honeycombs, channels, and cells, all, some or none of which may be interconnected.

In various embodiments, the break-away component layer comprises one or both of minor and major break-away elements. In some such embodiments, there may be a series of break-away elements ranging from minor to one or more intermediate to major. In some embodiments, any of the one or more break-away elements are multi-planar, that is, there are multiple orientations of break-away elements. When two or more of minor, intermediate and major break-away elements are present in a break-away component layer, the break-away elements may vary in any one or more of shape, orientation, dimensions, distribution, frequency, material of manufacture, and structure. In some embodiments, the material of a break-away elements is selected for its breaking threshold. In some embodiments, the breaking threshold of a break-away elements is engineered though the use of notches or other strategically placed break points. In some embodiments, break-away component layers may be prepared at least in part by additive manufacturing. In some embodiments, break-away elements of the component layers may be prepared at least in part by additive manufacturing. In some embodiments, all or a portion of break-away elements may be formed of a material that is re-generable or healing, such that minor breaks and crushing may recover through elastomeric or chemical regeneration.

In various embodiments, the component layers may provide for multiple uses (i.e., not single use) of a protective article to the extent that there is not a major impulse or direct impact that effectively compromises a large portion of the article or any component layer thereof. Thus, in some examples, repeated minor hits or indirect vibrational impacts may be possible within the useful lifespan of a protective article, such as for example a football helmet which has not sustained a significant direct impact.

EXAMPLE 1: EMBODIMENT OF PROTECTIVE HELMET

In an exemplary embodiment according to this disclosure, a protective helmet is provided. The design is particularly well suited for protecting against injury that arises from direct impact to the head as well as indirect impacts. The helmet 70 includes:

- a resilient outer shell that forms a shield component layer 30 that is thin, lightweight and rigid, and has an outer surface that comprises a friction mitigating layer at least a portion of which has a low coefficient of friction (from less than to approximately equal to the coefficient of friction of ice at 0 degrees C.), the shield component layer 30 having a hardness and brittleness selected for initially receiving and resisting high impact prior to fracture, and due to the low friction surface is capable of slipping when in contact with another surface to initially influence deceleration of the assembly;
- at least a first slip component layer 40 situated between the outer shield component layer 30 and the wearer's head, the slip component layer 40 comprising one or more lubricious components, provided in a matrix, or free flowing, or in sections, or combinations of these;
- at least a first crush component layer 20 situated between the outer shield component layer 30 and the slip component layer 40, the crush component layer 20 formed of a basic truss structure 22 and formed into a three dimensional array so as to have specifically programmed material and dimensional properties selected to linear impact loads ranging from 20 to 1000 $N/m^2$ and rotational/angular impact loads ranging from 20 to 300 kg $m^2/s^2$ of torque; and
- wherein, the overall structure of the helmet 70 is consistent with the conventional art, being lightweight, and comprising an overall ellipsoid shape that covers at least the top one third of the head, with at least one strap or other fixation element to retain the helmet 70 in place on the wearer's head.

Figure 7:
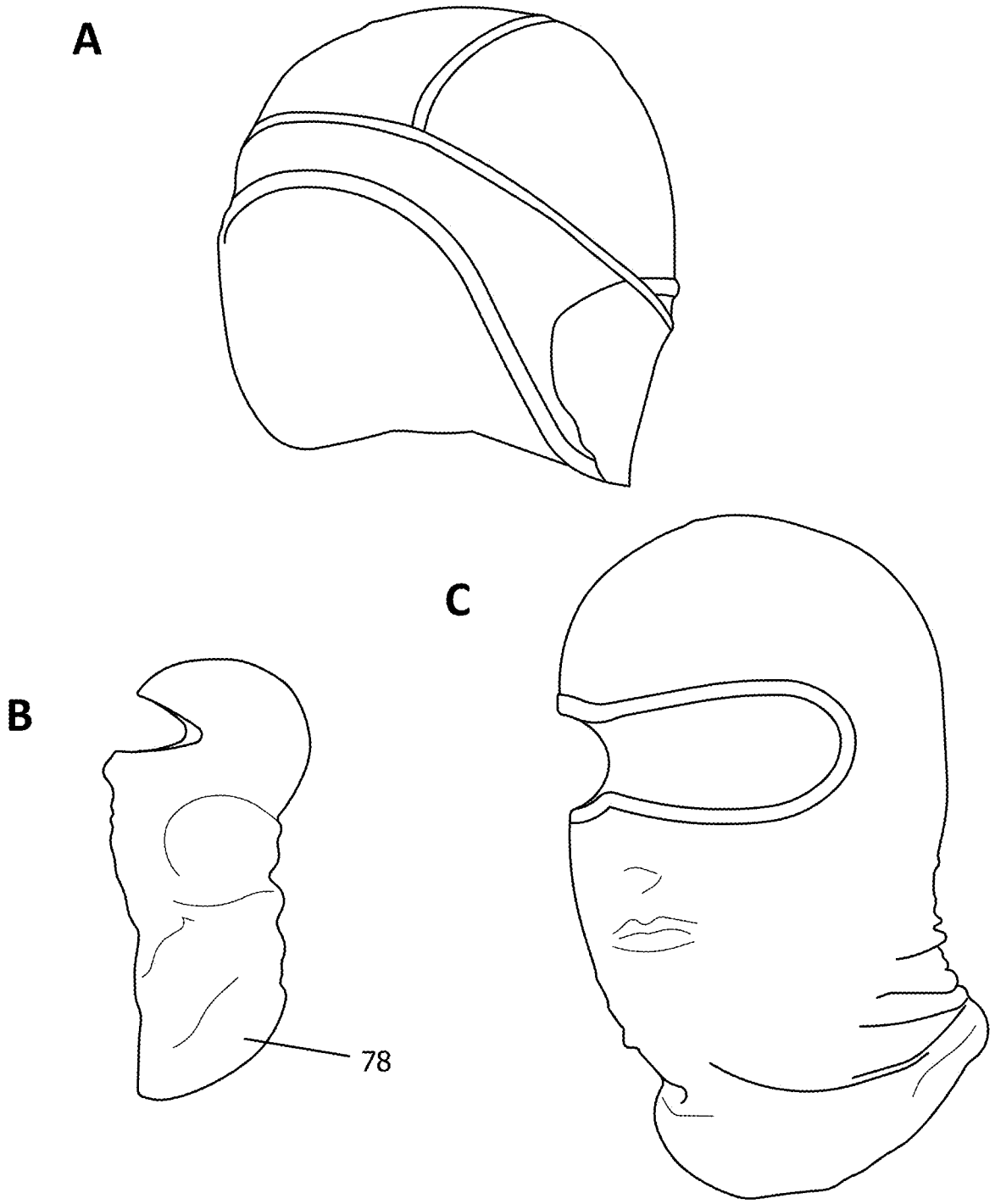
FIG 7 (PRIOR ART)
FIG. 7A-C shows examples of different types of prior art sleeve or slip on head gear for sports.

The helmet 70 may be assembled in a variety of ways. In a representative example, the helmet 70 includes an inner assembly 110 that is adapted to conform to the wearer's head such that the helmet 70 includes an inner sleeve having a configuration that is generally as shown in the prior art sleeve as shown in FIG. 7 of the drawings, the sleeve being stretchy and formed of a fabric or net that allows a close fit to the wearer's head, the slip component and crush component layers 40, 20, being affixed thereto in a manner to allow them to free float relative to the inner sleeve, and insertable and attachable within a frame 100 that includes the resilient outer shell. In use, the inner assembly 110 and frame 100 may be preassembled and donned as one piece by a wearer, or it may be disassembled such that the inner assembly 110 may be donned then a frame 100 may be attached to complete the full protective article 10.

In some embodiments according to this exemplary helmet design, an additional slip component layer 40 may be provided between the outer shell 30 and the crush component layer 20.

EXAMPLE 2: EMBODIMENT OF PROTECTIVE HELMET

In another exemplary embodiment according to this disclosure, a protective helmet 70 is provided. The design is particularly well suited for protecting against injury from impulses at preselected energy thresholds. The helmet 70 includes:

- a resilient outer shell 30 that comprises a friction mitigating outer surface layer;
- at least a first crush component layer 20 situated adjacent to the outer shield component layer 30, the crush component layer 20 formed into a three dimensional array and having specifically programmed material and dimensional properties selected to dissipate linear impact loads ranging from 20 to 1000 $N/m^2$ and rotational/angular impact loads ranging from 20 to 300 kg $m^2/s^2$ of torque;
- at least a first slip component layer 40 situated between the crush component layer 20 and the wearer's head;
- wherein, the overall structure of the helmet 70 is consistent with the conventional art, being lightweight, and comprising an overall ellipsoid shape that covers at least the top one third of the head, with at least one strap 90 or other fixation element to retain the helmet 70 in place on the wearer's head.

The helmet 70 may be assembled in a variety of ways. In a representative example, the helmet 70 comprises a suspension system, such as for example semi flexible net or fabric or elastomeric suspenders or sheets, wherein each of the crush and slip component layers 20, 40 are independently suspended relative to one another and are affixed to an interior surface of a frame that comprises the resilient outer shell.

In some embodiments, the exemplary helmet 70 is adapted to receive a separate assembly that is adapted to fit closely to the wearer's head, according to the various embodiments of the protective head gear 70 described in EXAMPLE 3.

In some embodiments according to this exemplary helmet 70 design, an additional slip layer may be provided between the outer shell and the crush layer.

EXAMPLE 3: EMBODIMENT OF PROTECTIVE HEAD GEAR

In another exemplary embodiment according to this disclosure, a protective head sleeve is provided. The design is particularly well suited for protecting against injury that arises from indirect impacts. The sleeve includes:

- an sleeve that is stretchy and formed of a fabric or net that allows a close fit to the wearer's head;
- at least a first slip component layer 40 comprising one or more lubricious components, provided in a matrix, or free flowing, or in sections, or combinations of these;
- at least a first crush component layer 20 situated adjacent to the slip component layer 40, the crush component layer 20 formed of a three dimensional array that comprises material and dimensional properties selected to dissipate linear impact loads ranging from 20 to 1000 $N/m^2$ and rotational/angular impact loads ranging from 20 to 300 kg $m^2/s^2$ of torque;
- wherein the slip component and crush component layers 40, 20 are affixed to the sleeve in a manner to allow them to free float relative to the sleeve;
- and wherein, the overall structure of the head gear 70 is consistent with slip on head gear 70 in the conventional art, being lightweight, and comprising an overall ellipsoid shape that covers at least the top one third of the head, with at least one strap 90 or other fixation element to retain the strap 90 in place on the wearer's head.

In some embodiments according to this exemplary protective head gear design 70, at least one supplemental slip component layer 40 may be provided. In some embodiments, the slip component layer 40 is integrated with the sleeve. In other embodiments, the gear comprises two slip component layers 40, one inside the sleeve and one on the outer surface of the sleeve to which is affixed the crush component layer 20. According to some embodiments, the protective head gear 70 comprises a suspension system, such as for example semi flexible net or fabric or elastomeric suspenders or sheets, wherein one or more of the crush and slip component layers 20, 40 are independently suspended relative to one another and are affixed to the sleeve.

In yet other embodiments according to this exemplary protective head gear 70 design, supplemental alternating crush and slip component layers 20, 40 may be provided. In yet other embodiments, the protective head gear 70 is intended for use alone and is suitable for sports and activates that are non-contact. In other embodiments, the protective head gear 70 is intended for use by modular engagement with a hard type helmet, and is suitable for sports and activities that are contact where a hard resilient outer layer is intended to protect against direct head impact. According to such embodiments, the protective head gear is attachable within a frame 100 that includes a resilient outer shell 30. In use, the inner assembly 110 and frame 100 may be preassembled and donned as one piece by a wearer, or it may be disassembled such that the inner assembly may be donned then a frame may be attached to complete the full protective head gear 70. In some embodiments according to this exemplary helmet design, an additional slip component layer 40 may be provided between the outer shell 30 and the crush component layer 20.

EXAMPLE 4: EMBODIMENT OF PROTECTIVE HEAD GEAR

In another exemplary embodiment according to this disclosure, a protective head guard is provided. The design is particularly well suited for protecting against injury that arises from indirect impacts. The head guard includes:

an conforming pliable helmet that allows a close fit to the wearer's head;

at least a first slip component layer 40 comprising one or more lubricious components, provided in a matrix, or free flowing, or in sections, or combinations of these;

at least a first crush component layer 20 situated adjacent to the slip component layer 40, the crush component layer 20 formed of a three dimensional array that comprises material and dimensional properties selected to dissipate linear impact loads ranging from 20 to 1000 $N/m^2$ and rotational/angular impact loads ranging from 20 to 300 kg $m^2/s^2$ of torque;

wherein the slip component 40 and crush component layers 20 are affixed to the pliable conforming helmet 70;

and wherein, the overall structure of the protective head gear 70 is consistent with pliable helmets in the conventional art, being lightweight, and comprising an overall ellipsoid shape that covers at least the top one third of the head, with an optional strap 90 or other fixation element to retain the pliable helmet 70 in place on the wearer's head.

In some embodiments according to this exemplary head gear 70 design, at least one supplemental slip component layer 40 may be provided. In some embodiments, the slip component layer 40 is integrated with the sleeve. In other embodiments, the protective head gear 70 comprises two slip component layers 40, one inside the sleeve and one on the outer surface of the sleeve to which is affixed the crush component layer 20. According to some embodiments, the protective head gear 70 comprises a suspension system, such as for example semi flexible net or fabric or elastomeric suspenders or sheets, wherein one or more of the crush and slip component layers 20, 40 are independently suspended relative to one another and are affixed to the sleeve.

In yet other embodiments according to this exemplary head gear 70 design, supplemental alternating crush 20 and slip component layers 40 may be provided. In yet other embodiments, the protective head gear 70 is intended for use alone and is suitable for sports and activities that are non-contact. In other embodiments, the protective head gear 70 is intended for use by modular engagement with a hard type helmet, and is suitable for sports and activities that are contact where a hard resilient outer layer is intended to protect against direct head impact. According to such embodiments, the protective head gear 70 is attachable within a frame that includes a resilient outer shell 30. In use, the inner assembly 110 and frame 100 may be preassembled and donned as one piece by a wearer, or it may be disassembled such that the inner assembly 110 may be donned then a frame 100 may be attached to complete the full protective head gear 70. In some embodiments according to this exemplary helmet design, an additional slip component layer may be provided between the outer shell 30 and the crush component layer 20.

According to the various embodiments of protective head gear 70, the one or more component layers comprises material and dimensional properties selected to dissipate linear impact loads ranging from 20 to 500 $N/m^2$ and rotational/angular impact loads ranging from 20 to 300 kg $m^2/s^2$ of torque.

In embodiments adapted for adult populations, the one or more component layers comprises material and dimensional properties selected to dissipate linear impact loads ranging from 20 to 500 $N/m^2$, and in some embodiments from 40 to 300 $N/m^2$, and some particular embodiments from 44 to 177 $N/m^2$, and in yet other particular embodiments from 88 to 252 $N/m^2$.

In embodiments adapted for adult populations, the one or more component layers comprises material and dimensional properties selected to dissipate angular impact loads ranging from 50 to 300 kg $m^2/s^2$ of torque, and in some embodiments from 50 to 240 kg $m^2/s^2$ of torque, and in some particular embodiments from 53 to 60 kg $m^2/s^2$ of torque, and in yet other particular embodiments from 213 to 237 kg $m^2/s^2$ of torque.

In embodiments adapted for pediatric populations, the one or more component layers comprises material and dimensional properties selected to dissipate linear impact loads ranging from 20 to 500 $N/m^2$, and in some embodiments from 50 to 300 $N/m^2$, and some particular embodiments from 59 to 252 $N/m^2$, and in yet other particular embodiments from 29 to 177 $N/m^2$.

In embodiments adapted for pediatric populations, the one or more component layers comprises material and dimensional properties selected to dissipate angular impact loads ranging from 20 to 300 kg $m^2/s^2$ of torque, and in some embodiments from 50 to 160 kg $m^2/s^2$ of torque, and in some particular embodiments from 25 to 38 kg $m^2/s^2$ of torque, and in yet other particular embodiments from 106 to 159 kg $m^2/s^2$ of torque, and in yet other particular embodiments from 21 to 32 kg $m^2/s^2$ of torque, and in yet other particular embodiments from 83 to 124 kg $m^2/s^2$ of torque.

EXAMPLE 5: EMBODIMENT OF PROTECTIVE CHEST GEAR

Figure 9:
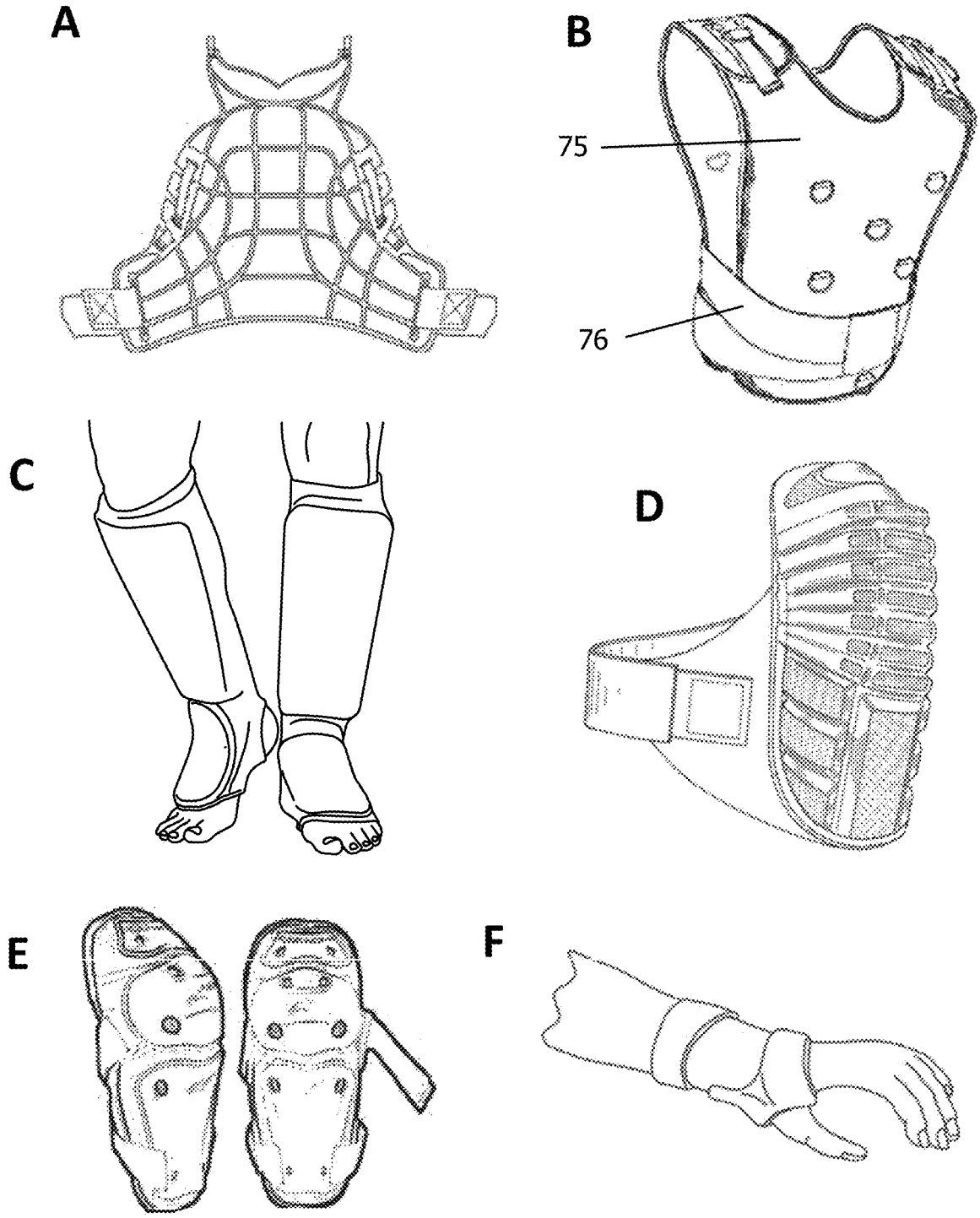
FIG 9 (PRIOR ART)
FIG. 9 shows examples of different types of prior art chest and extremity protectors ("guards") for various sports, each guard including a body portion and straps or harness features, including, referring from top left to bottom right, chest guards (FIG. 9A and FIG. 9B), shin/foot (instep) guard (FIG. 9C); knee pad (FIG. 9D); elbow guards (FIG. 9E); and wrist guard (FIG. 9F)

In another exemplary embodiment according to this disclosure, a protective chest guard is provided. The design is particularly well suited for protecting against injury that arises from both direct and indirect impacts. The chest guard includes:

a flexible harness including shoulder straps and a securement mechanism;

a guard body having a configuration that is generally as shown in the prior art chest guard as shown in FIG. 9 of the drawings, the guard body engagable with the harness 76_and sized to cover at least a portion of the chest area, the guard body 75 comprising at least one crush component layer 20 component formed of a three dimensional array that comprises material and dimensional properties selected to dissipate linear impact loads ranging from 20 to 900 $N/m^2$;

wherein the guard body 75 is engaged with the harness in a manner that allows free movement of the wearer's arms relative to the guard body 75; and wherein the overall structure of the chest guard is consistent with chest guards and chest guard apparel in the conventional art, being lightweight, the guard body 75 having an overall shape and profile that covers at least the portion of the wearer's chest.

In some embodiments, the guard body 75 is removable from the harness. In some embodiments, the harness comprises a garment selected from a shirt and a vest, wherein the garment is wearable separate from the guard body 75 and is adapted to receive guard body 75 components and replacement guard body 75 components. Thus, in some embodiments, a modular chest protector is provided with a harness component and replaceable guard body 75 components. In some such embodiments, the guard body 75 components are provided in an array with varying arrangements and properties, and according to such embodiments, the guard body 75 components may be unity, or segmented and may comprise different component layers.

In some embodiments, the guard body 75 and harness are adapted to provide coverage to the wearer from at or above the clavicles to the bottom of the rib cage. In other embodiments, the guard body 75 and harness are adapted to provide coverage to the wearer from the top of the hip bones of the wearer.

In some embodiments, the guard body 75 is comprised of multiple segments, each segment engaged to adjacent segments with flexible material to allow relative motion of the segments while maintaining them within a fixed range of proximity.

In some embodiments, a guard body 75 comprises segments that are varied in terms of the composite layers, wherein different adjacent segments comprise different layers and layers with different properties selected from the layers as described in this disclosure.

In some embodiments, the guard body 75 comprises at least a first slip component layer 40 comprising one or more lubricious components, provided in a matrix, or free flowing, or in sections, or combinations of these.

In some embodiments according to this exemplary design, supplemental alternating crush 20 and slip component layers 40 may be provided.

EXAMPLE 6: EMBODIMENT OF PROTECTIVE GEAR FOR EXTREMITIES

In another exemplary embodiment according to this disclosure, a protective guard for an extremity, such as a knee, shin, elbow, groin, is provided. The design is particularly well suited for protecting against injury that arises from direct impacts. The guard includes:

- a guard body 75 engageably sized to cover at least a portion of the chest area, the guard body 75 comprising on its outer surface a resilient outer shell 30 that forms a shield component layer 30 that is thin, lightweight and rigid, and has an outer surface that comprises a friction mitigating layer at least a portion of which has a low coefficient of friction (from less than to approximately equal to the coefficient of friction of ice at 0 degrees C.), the shield component layer 30 having a hardness and brittleness selected for initially receiving and resisting high impact prior to fracture, and due to the low friction surface is capable of slipping when in contact with another surface to initially influence deceleration of the assembly 110, the guard body 75 further comprising at least one crush component layer 20 adjacent to the outer shell component 30, the crush component layer 20 formed of a three dimensional array that comprises material and dimensional properties selected to dissipate linear impact loads ranging from 20 to 1000 $N/m^2$;
- a securement feature that is adapted to secure the guard body 75 to the body part to be protected;
- wherein the guard body 75 is engaged with the securement feature in a manner that allows free movement of the wearer's protective body part; and
- wherein the overall structure of the securement feature is consistent with securement of similar body protection gear in the conventional art, being lightweight, and having an overall shape and profile that is affixable to the body part to be protected.

In some embodiments, the guard body 75 is removable from the securement feature. In some embodiments, the securement feature is one or a plurality of straps, ties or adjustable bands that are affixed around the body part to be protected and secure the guard body 75 on the surface of the protected part. In some embodiments, the securement finite element analysis feature is a garment selected from a flexible sleeve 78, sock or band, wherein the garment is wearable separate from the guard body 75 and is adapted to receive the guard body 75 components and replacement guard body 75 components. Thus, in some embodiments, a modular extremity protector is provided with a securement component and replaceable guard body 75 components that may be interchanged and usable with other securement garments. In some such embodiments, the guard body 75 components are provided in an array with varying arrangements and properties, and according to such embodiments, the guard body 75 components may be unity, or segmented and may comprise different component layers.

In some embodiments, the securement feature is configured to expose the outer shell 30 so as to maximize the opportunity for slippage along an impacted surface. In other embodiments, the securement feature comprises a sleeve that encases the guard body 75 and comprises a fiction mitigating material or component layer to provide a means for maximizing slippage of the guard on an impacted surface.

In some embodiments, the guard body 75 is comprised of multiple segments, each segment engaged to adjacent segments with flexible material to allow relative motion of the segments while maintaining them within a fixed range of proximity.

In some embodiments, a guard body 75 comprises segments that are varied in terms of the composite layers, wherein different adjacent segments comprise different layers and layers with different properties selected from the layers as described in this disclosure.

In some embodiments, the guard body 75 comprises at least a first slip component layer 40 comprising one or more lubricious components, provided in a matrix, or free flowing, or in sections, or combinations of these. In some embodiments according to this exemplary design, supplemental alternating crush and slip component layers 20, 40 may be provided.

According to the various embodiments of protective chest and extremity gear, the one or more component layers comprises material and dimensional properties selected to dissipate linear impact loads ranging from 20 to 1000 $N/m^2$.

In embodiments adapted for adult populations, the one or more component layers comprises material and dimensional properties selected to dissipate linear impact loads ranging from 20 to 1000 $N/m^2$, and in some embodiments from 50 to 900 $N/m^2$, and some particular embodiments from 81 to 590 $N/m^2$, and in yet other particular embodiments from 163 to 840 $N/m^2$.

In embodiments adapted for pediatric populations, the one or more component layers comprises material and dimensional properties selected to dissipate linear impact loads ranging from 30 to 800 $N/m^2$, and in some embodiments from 27 to 513 $N/m^2$, and some particular embodiments from 53 to 730 $N/m^2$.

Alternate Embodiments for Exemplary Protective Gear in the Examples

In accordance with the various embodiments of protective gear described herein, and the examples shown herein above, it will be appreciated that a number of aspects of protective gear may be varied as described in this disclosure, and such variations include, for example, the following:

In some embodiments, the crush component layer 20 may alternately be formed with another cell array, such as a honeycomb 24 or other regular array, or from an array having an irregular or a variable distribution of cells.

In some embodiments, at least one crush component layer 20 may be provided in a continuous sheet that is essentially contiguous in area with the surface area of the wearer's protected body part as received in the gear frame 100. In other embodiments, at least one crush component layer 20 may be provided as discontinuous segments that are suspended in a flexible or rigid fabric or net such that they are placed at preselected positions to cover select areas of the surface area of the wearer's protected body part as received in the gear frame 100.

In some embodiments, at least one slip component layer 40 may be provided in a continuous sheet that is essentially contiguous in area with the surface area of the wearer's protected body part as received in the gear frame 100. In other embodiments, at least one slip component layer 40 may be provided as discontinuous segments that are suspended in a flexible or rigid fabric or net such that they are placed at preselected positions to cover select areas of the surface area of the wearer's protected body part as received in the gear frame 100.

In various embodiments, continuous and discontinuous layers of at least one slip component layer 40 and at least one crush component layer 20 may be combined in various combinations.

In all the various embodiments, the component layers, and in particular the crush component layers 20 may be manufactured conventionally by subtractive methods, or by additive methods, or combinations of these. Thus, in those embodiments where the performance of a crush component layer 20 is specifically programmed to withstand forces as described herein, the crush component layer 20 may be manufactured to meet those specifications through additive manufacturing whereby the individual cell components and the array shape and structure, dimensions, thickness, and materials may all be varied to achieve the force energy absorption selected for use in a particular protective gear application.

In all the various embodiments, protective gear and articles 10 may further comprise additional layers as disclosed herein. Accordingly, the various embodiments may comprise one or more contact friction mitigating component layers that is relatively thin and rigid with selected surface properties including a low coefficient of friction, which contact friction mitigation components may be separate from or integral with and comprise a surface on a shield component layer or shell 30. And, the various embodiments may comprise one or more break-away component layers that releasably binds two adjacent layers.

And in the various embodiments of protective gear as described herein, the one or more component layers comprises material and dimensional properties selected to dissipate linear impact loads that range in $N/m^2$ from 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, 50, 51, 52, 53, 54, 55, 56, 57, 58, 59, 60, 61, 62, 63, 64, 65, 66, 67, 68, 69, 70, 71, 72, 73, 74, 75, 76, 77, 78, 79, 80, 81, 82, 83, 84, 85, 86, 87, 88, 89, 90, 91, 92, 93, 94, 95, 96, 97, 98, 99, 100, 101, 102, 103, 104, 105, 106, 107, 108, 109, 110, 111, 112, 113, 114, 115, 116, 117, 118, 119, 120, 121, 122, 123, 124, 125, 126, 127, 128, 129, 130, 131, 132, 133, 134, 135, 136, 137, 138, 139, 140, 141, 142, 143, 144, 145, 146, 147, 148, 149, 150, 151, 152, 153, 154, 155, 156, 157, 158, 159, 160, 161, 162, 163, 164, 165, 166, 167, 168, 169, 170, 171, 172, 173, 174, 175, 176, 177, 178, 179, 180, 181, 182, 183, 184, 185, 186, 187, 188, 189, 190, 191, 192, 193, 194, 195, 196, 197, 198, 199, 200, 201, 202, 203, 204, 205, 206, 207, 208, 209, 210, 211, 212, 213, 214, 215, 216, 217, 218, 219, 220, 221, 222, 223, 224, 225, 226, 227, 228, 229, 230, 231, 232, 233, 234, 235, 236, 237, 238, 239, 240, 241, 242, 243, 244, 245, 246, 247, 248, 249, 250, 251, 252, 253, 254, 255, 256, 257, 258, 259, 260, 261, 262, 263, 264, 265, 266, 267, 268, 269, 270, 271, 272, 273, 274, 275, 276, 277, 278, 279, 280, 281, 282, 283, 284, 285, 286, 287, 288, 289, 290, 291, 292, 293, 294, 295, 296, 297, 298, 299, 300, 301, 302, 303, 304, 305, 306, 307, 308, 309, 310, 311, 312, 313, 314, 315, 316, 317, 318, 319, 320, 321, 322, 323, 324, 325, 326, 327, 328, 329, 330, 331, 332, 333, 334, 335, 336, 337, 338, 339, 340, 341, 342, 343, 344, 345, 346, 347, 348, 349, 350, 351, 352, 353, 354, 355, 356, 357, 358, 359, 360, 361, 362, 363, 364, 365, 366, 367, 368, 369, 370, 371, 372, 373, 374, 375, 376, 377, 378, 379, 380, 381, 382, 383, 384, 385, 386, 387, 388, 389, 390, 391, 392, 393, 394, 395, 396, 397, 398, 399, 400, 401, 402, 403, 404, 405, 406, 407, 408, 409, 410, 411, 412, 413, 414, 415, 416, 417, 418, 419, 420, 421, 422, 423, 424, 425, 426, 427, 428, 429, 430, 431, 432, 433, 434, 435, 436, 437, 438, 439, 440, 441, 442, 443, 444, 445, 446, 447, 448, 449, 450, 451, 452, 453, 454, 455, 456, 457, 458, 459, 460, 461, 462, 463, 464, 465, 466, 467, 468, 469, 470, 471, 472, 473, 474, 475, 476, 477, 478, 479, 480, 481, 482, 483, 484, 485, 486, 487, 488, 489, 490, 491, 492, 493, 494, 495, 496, 497, 498, 499, 500, 501, 502, 503, 504, 505, 506, 507, 508, 509, 510, 511, 512, 513, 514, 515, 516, 517, 518, 519, 520, 521, 522, 523, 524, 525, 526, 527, 528, 529, 530, 531, 532, 533, 534, 535, 536, 537, 538, 539, 540, 541, 542, 543, 544, 545, 546, 547, 548, 549, 550, 551, 552, 553, 554, 555, 556, 557, 558, 559, 560, 561, 562, 563, 564, 565, 566, 567, 568, 569, 570, 571, 572, 573, 574, 575, 576, 577, 578, 579, 580, 581, 582, 583, 584, 585, 586, 587, 588, 589, 590, 591, 592, 593, 594, 595, 596, 597, 598, 599, 600, 601, 602, 603, 604, 605, 606, 607, 608, 609, 610, 611, 612, 613, 614, 615, 616, 617, 618, 619, 620, 621, 622, 623, 624, 625, 626, 627, 628, 629, 630, 631, 632, 633, 634, 635, 636, 637, 638, 639, 640, 641, 642, 643, 644, 645, 646, 647, 648, 649, 650, 651, 652, 653, 654, 655, 656, 657, 658, 659, 660, 661, 662, 663, 664, 665, 666, 667, 668, 669, 670, 671, 672, 673, 674, 675, 676, 677, 678, 679, 680, 681, 682, 683, 684, 685, 686, 687, 688, 689, 690, 691, 692, 693, 694, 695, 696, 697, 698, 699, 700, 701, 702, 703, 704, 705, 706, 707, 708, 709, 710, 711, 712, 713, 714, 715, 716, 717, 718, 719, 720, 721, 722, 723, 724, 725, 726, 727, 728, 729, 730, 731, 732, 733, 734, 735, 736, 737, 738, 739, 740, 741, 742, 743, 744, 745, 746, 747, 748, 749, 750, 751, 752, 753, 754, 755, 756, 757, 758, 759, 760, 761, 762, 763, 764, 765, 766, 767, 768, 769, 770, 771, 772, 773, 774, 775, 776, 777, 778, 779, 780, 781, 782, 783, 784, 785, 786, 787, 788, 789, 790, 791, 792, 793, 794, 795, 796, 797, 798, 799, 800, 801, 802, 803, 804, 805, 806, 807, 808, 809, 810, 811, 812, 813, 814, 815, 816, 817, 818, 819, 820, 821, 822, 823, 824, 825, 826, 827, 828, 829, 830, 831, 832, 833, 834, 835, 836, 837, 838, 839, 840, 841, 842, 843, 844, 845, 846, 847, 848, 849, 850, 851, 852, 853, 854, 855, 856, 857, 858, 859, 860, 861, 862, 863, 864, 865, 866, 867, 868, 869, 870, 871, 872, 873, 874, 875, 876, 877, 878, 879, 880, 881, 882, 883, 884, 885, 886, 887, 888, 889, 890, 891, 892, 893, 894, 895, 896, 897, 898, 899, 900, 901, 902, 903, 904, 905, 906, 907, 908, 909, 910, 911, 912, 913, 914, 915, 916, 917, 918, 919, 920, 921, 922, 923, 924, 925, 926, 927, 928, 929, 930, 931, 932, 933, 934, 935, 936, 937, 938, 939, 940, 941, 942, 943, 944, 945, 946, 947, 948, 949, 950, 951, 952, 953, 954, 955, 956, 957, 958, 959, 960, 961, 962, 963, 964, 965, 966, 967, 968, 969, 970, 971, 972, 973, 974, 975, 976, 977, 978, 979, 980, 981, 982, 983, 984, 985, 986, 987, 988, 989, 990, 991, 992, 993, 994, 995, 996, 997, 998, 999, to 1000.

And in the various embodiments of protective gear as described herein, the one or more component layers comprises material and dimensional properties selected to dissipate angular impact loads that range in kg $m^2/s^2$ torque from 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, 50, 51, 52, 53, 54, 55, 56, 57, 58, 59, 60, 61, 62, 63, 64, 65, 66, 67, 68, 69, 70, 71, 72, 73, 74, 75, 76, 77, 78, 79, 80, 81, 82, 83, 84, 85, 86, 87, 88, 89, 90, 91, 92, 93, 94, 95, 96, 97, 98, 99, 100, 101, 102, 103, 104, 105, 106, 107, 108, 109, 110, 111, 112, 113, 114, 115, 116, 117, 118, 119, 120, 121, 122, 123, 124, 125, 126, 127, 128, 129, 130, 131, 132, 133, 134, 135, 136, 137, 138, 139, 140, 141, 142, 143, 144, 145, 146, 147, 148, 149, 150, 151, 152, 153, 154, 155, 156, 157, 158, 159, 160, 161, 162, 163, 164, 165, 166, 167, 168, 169, 170, 171, 172, 173, 174, 175, 176, 177, 178, 179, 180, 181, 182, 183, 184, 185, 186, 187, 188, 189, 190, 191, 192, 193, 194, 195, 196, 197, 198, 199, 200, 201, 202, 203, 204, 205, 206, 207, 208, 209, 210, 211, 212, 213, 214, 215, 216, 217, 218, 219, 220, 221, 222, 223, 224, 225, 226, 227, 228, 229, 230, 231, 232, 233, 234, 235, 236, 237, 238, 239, 240, 241, 242, 243, 244, 245, 246, 247, 248, 249, 250, 251, 252, 253, 254, 255, 256, 257, 258, 259, 260, 261, 262, 263, 264, 265, 266, 267, 268, 269, 270, 271, 272, 273, 274, 275, 276, 277, 278, 279, 280, 281, 282, 283, 284, 285, 286, 287, 288, 289, 290, 291, 292, 293, 294, 295, 296, 297, 298, 299, 300, 301, 302, 303, 304, 305, 306, 307, 308, 309, 310, 311, 312, 313, 314, 315, 316, 317, 318, 319, 320, 321, 322, 323, 324, 325, 326, 327, 328, 329, 330, 331, 332, 333, 334, 335, 336, 337, 338, 339, 340, 341, 342, 343, 344, 345, 346, 347, 348, 349, 350, 351, 352, 353, 354, 355, 356, 357, 358, 359, 360, 361, 362, 363, 364, 365, 366, 367, 368, 369, 370, 371, 372, 373, 374, 375, 376, 377, 378, 379, 380, 381, 382, 383, 384, 385, 386, 387, 388, 389, 390, 391, 392, 393, 394, 395, 396, 397, 398, 399, 400, 401, 402, 403, 404, 405, 406, 407, 408, 409, 410, 411, 412, 413, 414, 415, 416, 417, 418, 419, 420, 421, 422, 423, 424, 425, 426, 427, 428, 429, 430, 431, 432, 433, 434, 435, 436, 437, 438, 439, 440, 441, 442, 443, 444, 445, 446, 447, 448, 449, 450, 451, 452, 453, 454, 455, 456, 457, 458, 459, 460, 461, 462, 463, 464, 465, 466, 467, 468, 469, 470, 471, 472, 473, 474, 475, 476, 477, 478, 479, 480, 481, 482, 483, 484, 485, 486, 487, 488, 489, 490, 491, 492, 493, 494, 495, 496, 497, 498, 499, to 500.

Figure 8:
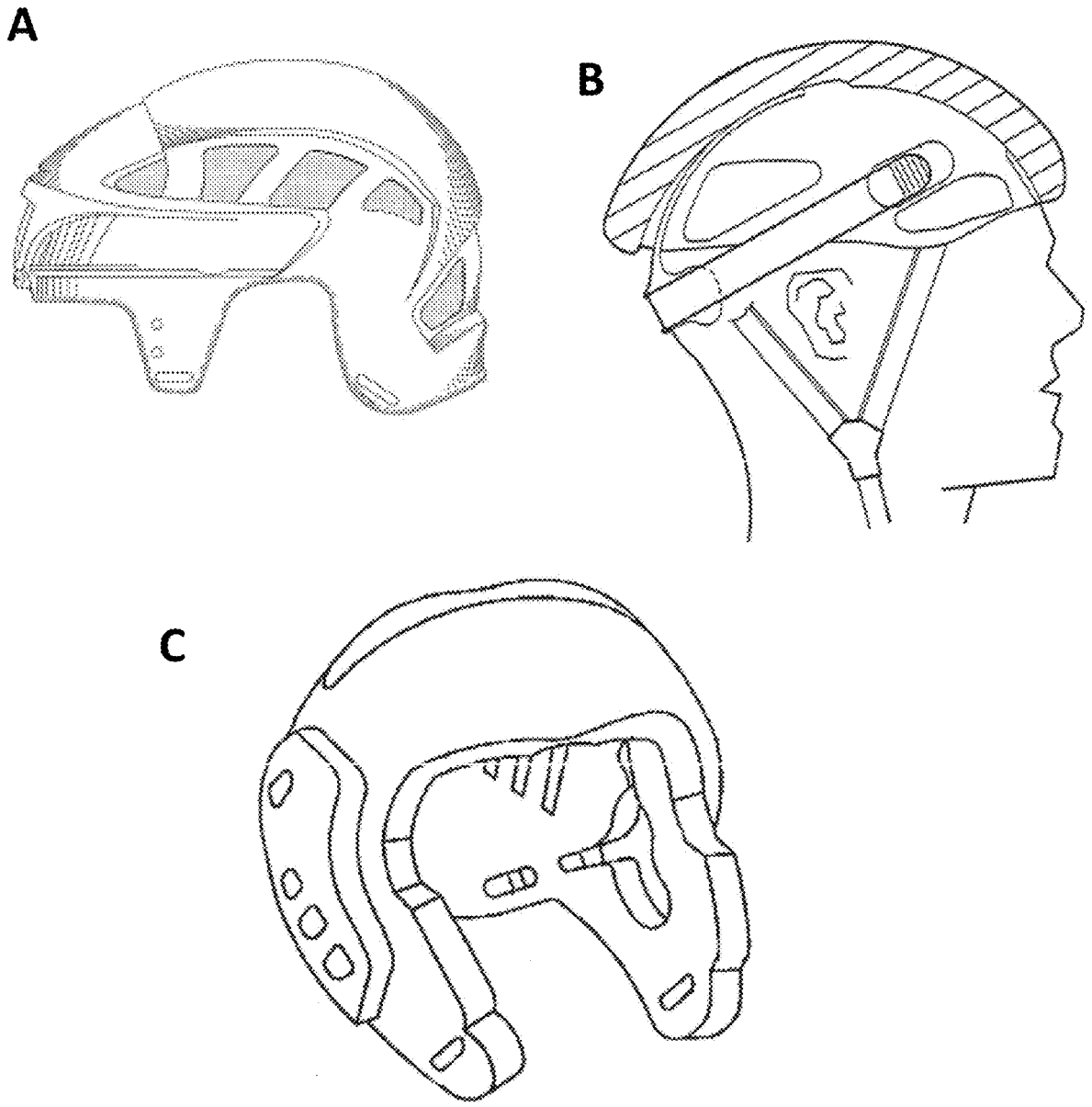
FIG 8 (PRIOR ART)
FIG. 8A-C shows examples of different types of prior art pliable head gear and helmets for various sports.

In accordance with the various embodiments as described herein, the profiles of the articles would in some embodiments be generally in accordance with protective gear in the art intended for a particular tissue. Thus, for example, in the case of helmets, the profile of the article would be generally as shown in FIG. 1, or alternatively for other sports such as cycling, the article would be configured for example according to one of the designs shown in FIG. 6. And in connection with protective head gear as described in the examples above, FIG. 7 shows examples of different types of prior art sleeve or slip on head gear for sports, and FIG. 8 shows examples of different types of prior art pliable head gear and helmets for various sports. Further, in the case of other protective gear, FIG. 9 shows examples of different types of prior art chest and extremity protectors for various sports, including chest guards, shin/foot (instep) guards; knee pad; elbow guards; and wrist guard, generically refereed to here as embodiments of a guard body 75. It will be appreciated by one of ordinary skill in the protective gear and sports and athletic clothing arts that a variety of other representative gear is suitable for use in connection with protective layers and padding. Thus, though the examples shown herein are suitable for use in connection with the inventive composites and articles disclosed in the specification, drawings and claims of this application, these examples are not intended to be limiting.

In other examples, embodiments of protective articles include knee, shin, elbow, wrist, and groin guards, protective footwear, insoles and soles.

Tissue Injury Thresholds

In accordance with the disclosure, in some embodiments protective articles are designed to perform with predetermined energy dissipative properties, including dispersion within and through one or more crush layers and one more slip layers. In some embodiments, these predetermined properties are based on known injury thresholds for tissue to be protected. Review of the relevant literature provides replete evidence of the known forms of injury caused by different types and magnitudes of forces, quite often to the level of detail of specific demographics in terms of age, sex, size and ability.

For example, data regarding brain tissue injury thresholds is available in the medical and scientific literature. The following tables show, respectively, brain tissue injury thresholds for adults, rotational acceleration thresholds to induce injuries depending to age/size. Design of protective layers for a particular tissue, for example helmets for protecting against brain injury, can be customized using this data as inputs for FEA models and mechanical constructs that can be optimized for their protective benefit.

TABLE 1

BRAIN TISSUE THRESHOLDS: ADULT

| THRESHOLDS | Injury | Non-Injury |
|---|---|---|
| Head Kinematics - Peak translational acceleration | 60-145 [g] | 30-102 [g] |
| Head Kinematics - Peak rotational acceleration | 4168-12,832 [rad/s$^2$] | 2087-6265 [rad/s$^2$] |
| Intracranial pressure | 53-130 [kPa] | 40-101 [kPa] |
| Brain Shear Stress | 6.2-12 [kPa] | 2.6-9.5 [kPa] |
| Impact Duration | | 2 msec |

REF Zhang L, Zhang L, Yang KH, King AI, A proposed injury threshold for mild traumatic brain injury, J. Biomech Engineering April, 2004, Vol. 126, pp: 226-236

TABLE 2

BRAIN THRESHOLDS FOR ADULT VS. PEDIATRICS
Rotational Acceleration Thresholds to Induce the Following Injuries

| | Brain Mass [grams] | Concussion [rad/s$^2$] | Mild DAI [rad/s$^2$] | Moderate DAI [rad/s$^2$] | Severe DAI [rad/s$^2$] |
|---|---|---|---|---|---|
| Adult Head | 1400 | 4,500 | 13,000 | 15,500 | 17,000-18,000 |
| Young Child | 800 | 6,000 | 18,000 | 21,000 | 25,000 |
| Neonate | 400 | 10,000 | 28,000-29,000 | 35,000 | 39,000 |

REF Ommaya AK, Goldsmith W, Thibault L, Bioechanics and neuropathology of adult and paediatric head injury, Br. J Neurosurgery, 2002: 16(3): 220-242.

TABLE 3

HEAD/BRAIN FORCE/UNIT AREA AT THRESHOLDS FOR ADULT VS. PEDIATRICS

| THRESHOLDS | Injury | Non-Injury |
|---|---|---|
| Head | | |
| Head Kinematics - Peak translational acceleration [g] | 60-145 | 30-102 |
| Head Kinematics - Peak rotational acceleration [rad/s$^2$] | 4168-12,832 | 2087-6265 |
| Force Range (N) - translational | 2670-6453 | 1335-4539 |
| Area of pediatric head (age 2-17) - (m$^2$) + 30% curvature | 0.022-0.039 | |
| Area of adult head - (m$^2$) + 30% for curvature | 0.033-0.039 | |
| Force/Surface area - [N/ m$^2$] - pediatric | 59-252<br>59-200 | 29-177<br>29-150 |
| Force/Surface area - [N/ m$^2$] - adult | 88-252 | 44-177 |

TABLE 4

BRAIN FORCE/UNIT AREA FOR ANGULAR THRESHOLDS FOR ADULT VS. PEDIATRICS

| | Brain Mass [grams] | Concussion [rad/s$^2$] | Severe DAI [rad/s$^2$] | concussion torque | concussion [kg-m$^2$/s$^2$] | severe | severe |
|---|---|---|---|---|---|---|---|
| Adult Head | 1400 | 4,500 | 17,000-18,000 | 53.3 | 59.3 | 213.3 | 237.1 |
| Young Child | 800 | 6,000 | 25,000 | 25.6 | 38.0 | 106.6 | 158.4 |
| Neonate | 400 | 10,000 | 39,000 | 21.3 | 31.7 | 83.1 | 123.6 |

Chest Injury Thresholds

In addition to the foregoing information on injury thresholds for brain, the clinical literature also provides guidance regarding injury thresholds for the chest and heart. Porcine tests were conducted in which the animals were impacted directly over the heart during various times in the cardiac cycle. Lacross balls at four speeds were used to induce this disorder in the porcine model to determine thresholds for the viability of chest protectors. Although the different commercially available chest protectors that were tested in these studies provided protection and potential reduction in the risk to commotio cordis, there were some limitations to this study with respect to the impact element and anatomy. The geometry of the thoracic cavity of the porcine differs from humans, where the human thorax is wider and shallower than the porcine, and could result in different outcomes. Therefore, chest protection should incorporate a greater margin of safety (2 to 3 times greater energy dissipation) than the thresholds. (2012, *Development of a biomechanical surrogate for the evaluation of commotio cordis protection—Nathan Dau—Wayne State University: At URL digitalcommons.wayne.edu/oa_dissertations*).

TABLE 5

CHEST FORCE/UNIT AREA AT THRESHOLDS FOR ADULT VS. PEDIATRICS

| THRESHOLDS | Injury | Non-Injury |
|---|---|---|
| Chest | | |
| Area of pediatric chest (age 2-17) - (m$^2$) | 0.02-0.11 | |
| Area of adult chest - (m$^2$) | 0.061-0.130 | |

TABLE 5-continued

CHEST FORCE/UNIT AREA AT THRESHOLDS FOR ADULT VS. PEDIATRICS

| THRESHOLDS | Injury | Non-Injury |
|---|---|---|
| Force/Surface area - [N/ m$^2$] - pediatric | 53-730 | 27-513 |
| Force/Surface area - [N/ m$^2$] - adult | 163-840 | 81-590 |

Finite Element Analysis and Validated FEA for Various Structures

Human soft and hard tissue is viscoelastic (behaves like a fluid and solid); response of tissue to impact/vibration is strain-rate dependent, which means that with fast loading energy, tissue has a stiffer response, there is less deformation, and the effects are more catastrophic to tissue, and in contrast, with slow loading energy, the tissue response is less stiff, and there is greater deformation resulting in greater energy dissipation from the tissue. Thus, with slow loading energy, lengthening of the deceleration time can result in less damage to tissue.

Use of a material that can diffuse the load, such as a multi-planar crush pattern, for example a truss design or honeycomb design, can increase the deceleration time (longer) thus absorbing the energy away from the tissue. These structures, in particular, the truss structure, have been shown to absorb the energy in multiple planes (compression, shear, tension, rotation, shear). Assessment of these forms by FEA was expected to show that the struts or walls of the truss and honeycomb cellular structures will deform and/or fracture upon impact with the deformation occurring in succession (not simultaneous from deep within to the outer layer of the structures)—and would provide the mechanism to lengthen the deceleration times, thereby absorbing energy away from protected tissue. Additionally, the wall or strut thickness can be changed, optimized, and 'programmed' based on known tissue injury data to predict and control deformation and energy absorption that would be commonly experienced under known circumstances, such as in particular sports and other activities.

To test the predicted performance capabilities of the crush layers and combined crush and slip layers disclosed in accordance with the disclosure, FEA studies were developed and executed to provide supportive analyses for the proposed concept of energy absorption during impact loading for controlled energy absorption for different load applications using variations in the geometrical configurations (e.g.: truss vs. honeycomb). The data support the ability to achieve 'controlled and programmable' structural deformation based on designed structural variations. Supplemental FEA studies are contemplated to provide additional supportive data for fluid or air filled crush layers. Finite Element Analysis studies of various crush layer models were conducted without and with the addition of multi-planar translational layers (slip layers) comprising fluid (non-Newtonian) to increase the 'sliding time' and slowly (not abruptly) decelerate human tissue in all planes of motion.

Finite Element Analysis models were developed for (1) a Honeycomb SLA (brittle polymeric material); (2) Simple truss structures (using selected materials from SLA, Kevlar, and titanium, and (3) Truss structures with varying multiple strut configurations.

EXAMPLE 1: MECHANICAL TESTING OF COMPRESSION LOADING OF HONEYCOMB STRUCTURES

Honeycomb structures in two wall thicknesses (2 mm and 3 mm) were tested to failure vertically and horizontally with compressive (i.e., not shear or torsional). Actual mechanical testing of honeycomb structures was performed at OrthoKinetic Testing Technologies in Shallotte, NC, which is both ISO 17025 and A2LA accredited. Finite element models were created and modeled in the exact manner as mechanical testing—test results were (stiffness and displacement) were used to validate the FEA.

Figure 10:
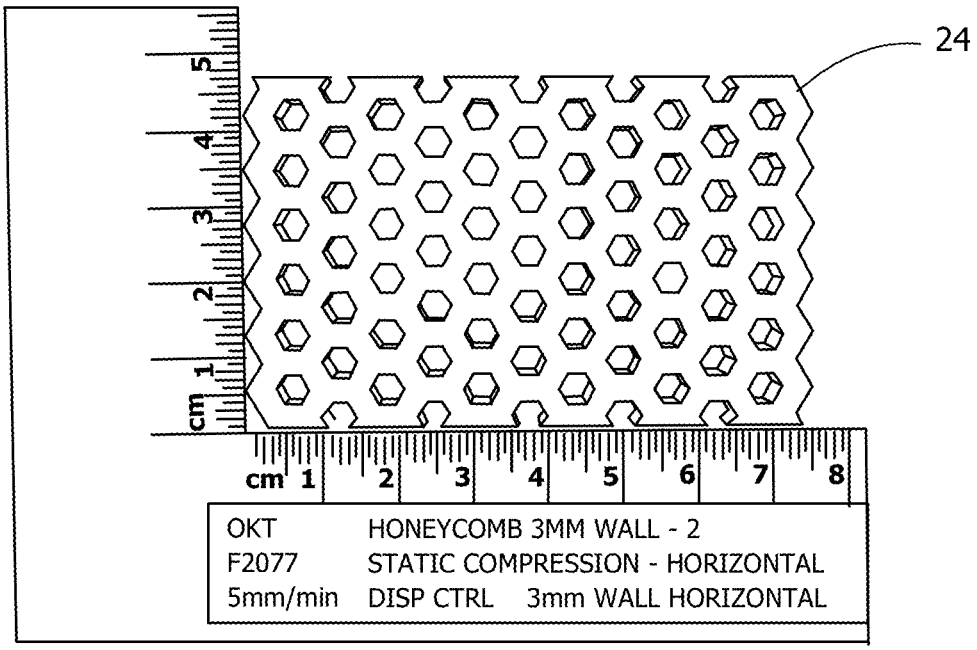
FIG. 10 shows photographs of mechanically tested honeycomb articles having a 3 mm wall thickness.
Figure 10:
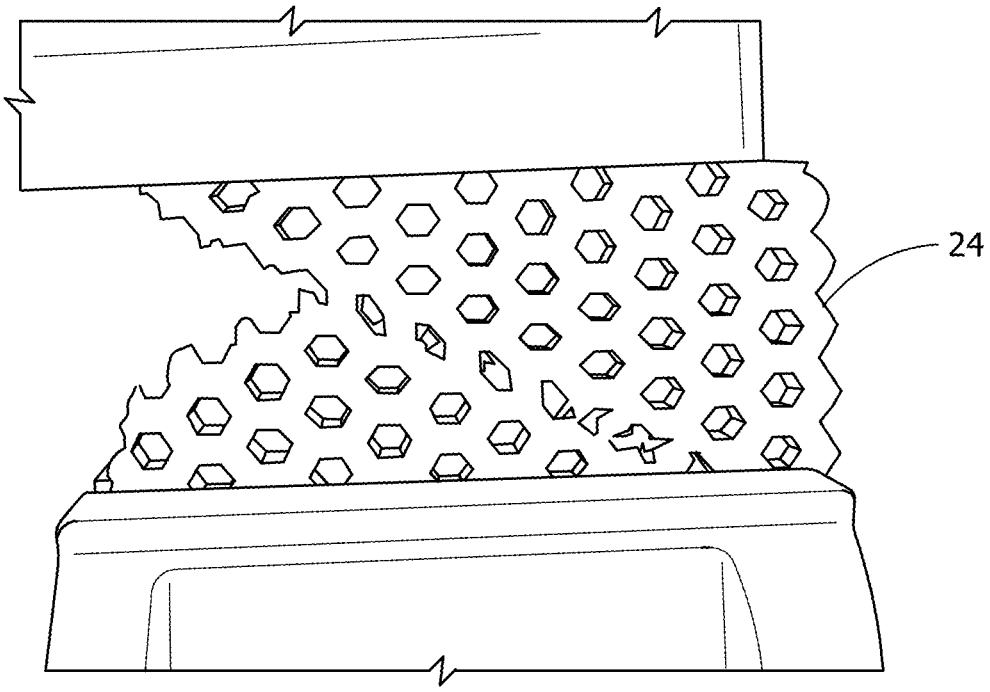

Referring again to the drawings, FIG. 10 shows photographs of tested honeycomb articles having a 3 mm wall thickness. Each of the 2 mm and 3 mm samples was tested both horizontally and vertically, and the horizontal configuration for each was tested at two speeds, slow @ 5 mm/min, and fast @ 8 mm/second. The results were used to validate the FEA models. As shown in FIG. 10, the deformations with greatest failures (failure mode is buckling) are present diagonally. Deformation by buckling in the context of a crush layer would absorb energy and add to energy deceleration time to provide a protective effect in an article such as a helmet. The mechanically measured stiffness, load magnitude, and displacements for the honeycomb samples were used to validate the FEA models.

Figure 11:
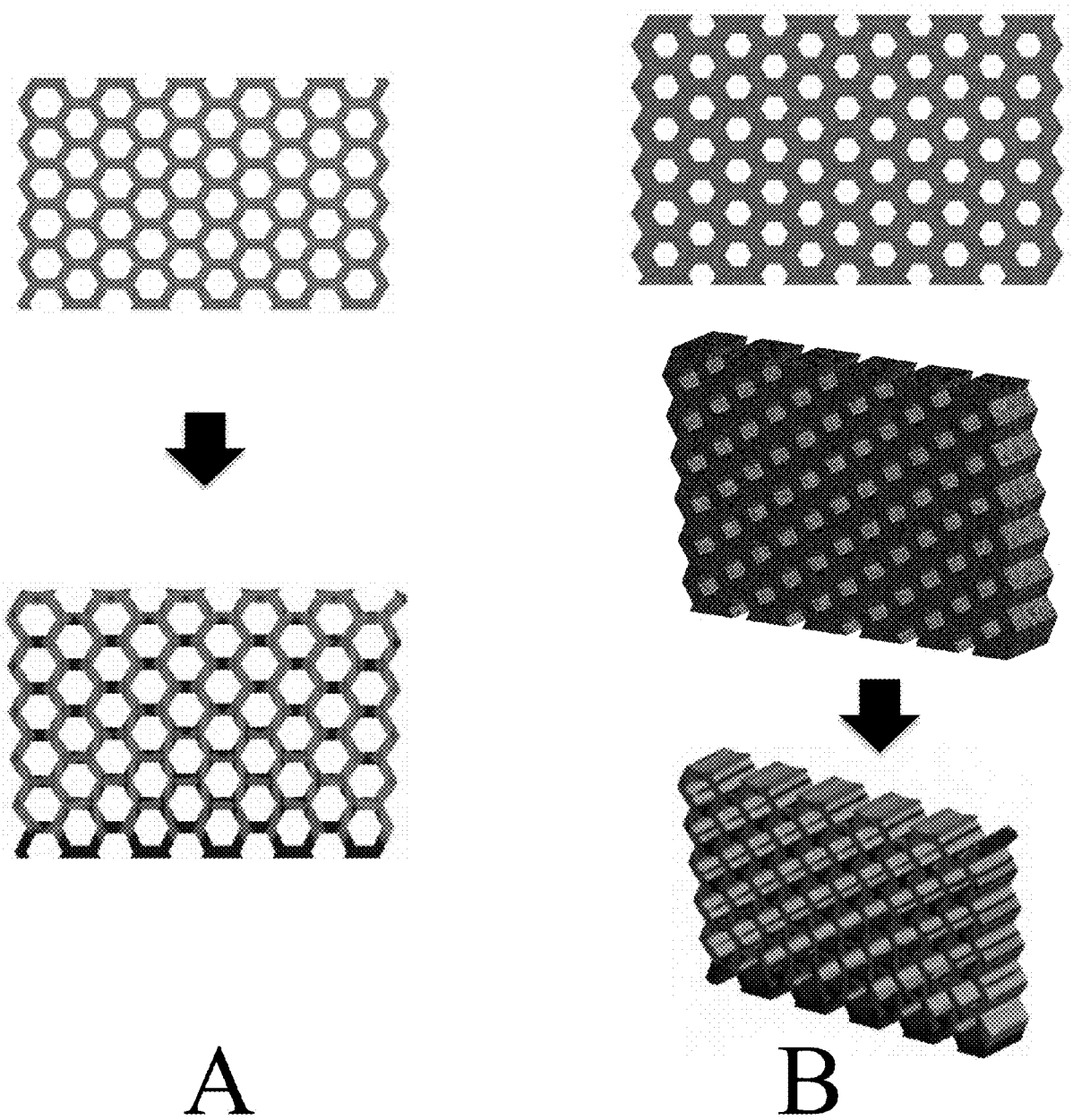
FIG. 11 shows finite element analysis (FEA) FEA results for honeycomb testing: panel A is a front view of a honeycomb structure having a 2 mm wall that was tested horizontally, and Panel B shows front and perspective views of a honeycomb structure having a 3 mm wall.
Figure 12:
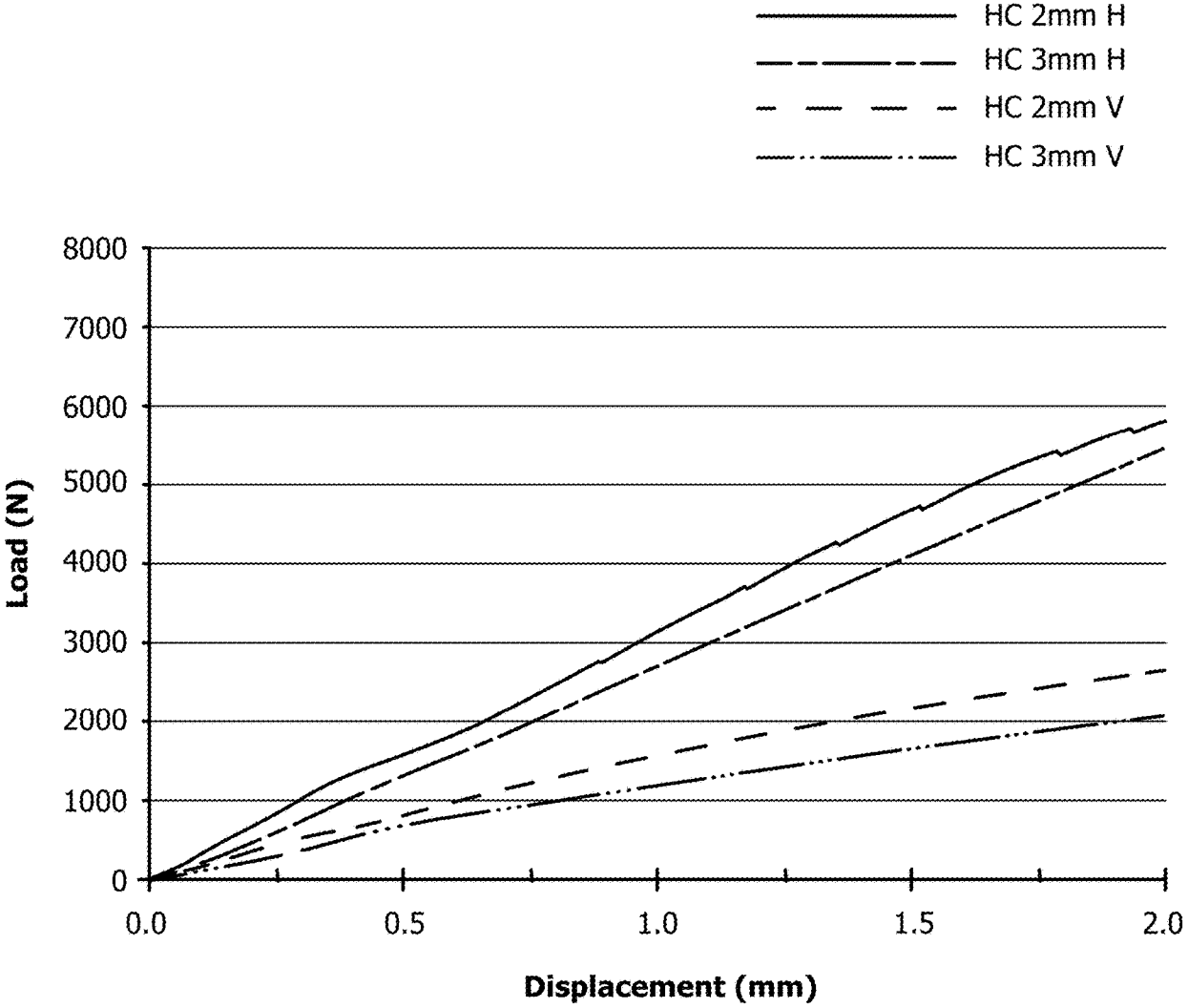
FIG. 12, which shows load vs displacement in honeycomb FEA testing.
Figure 21:
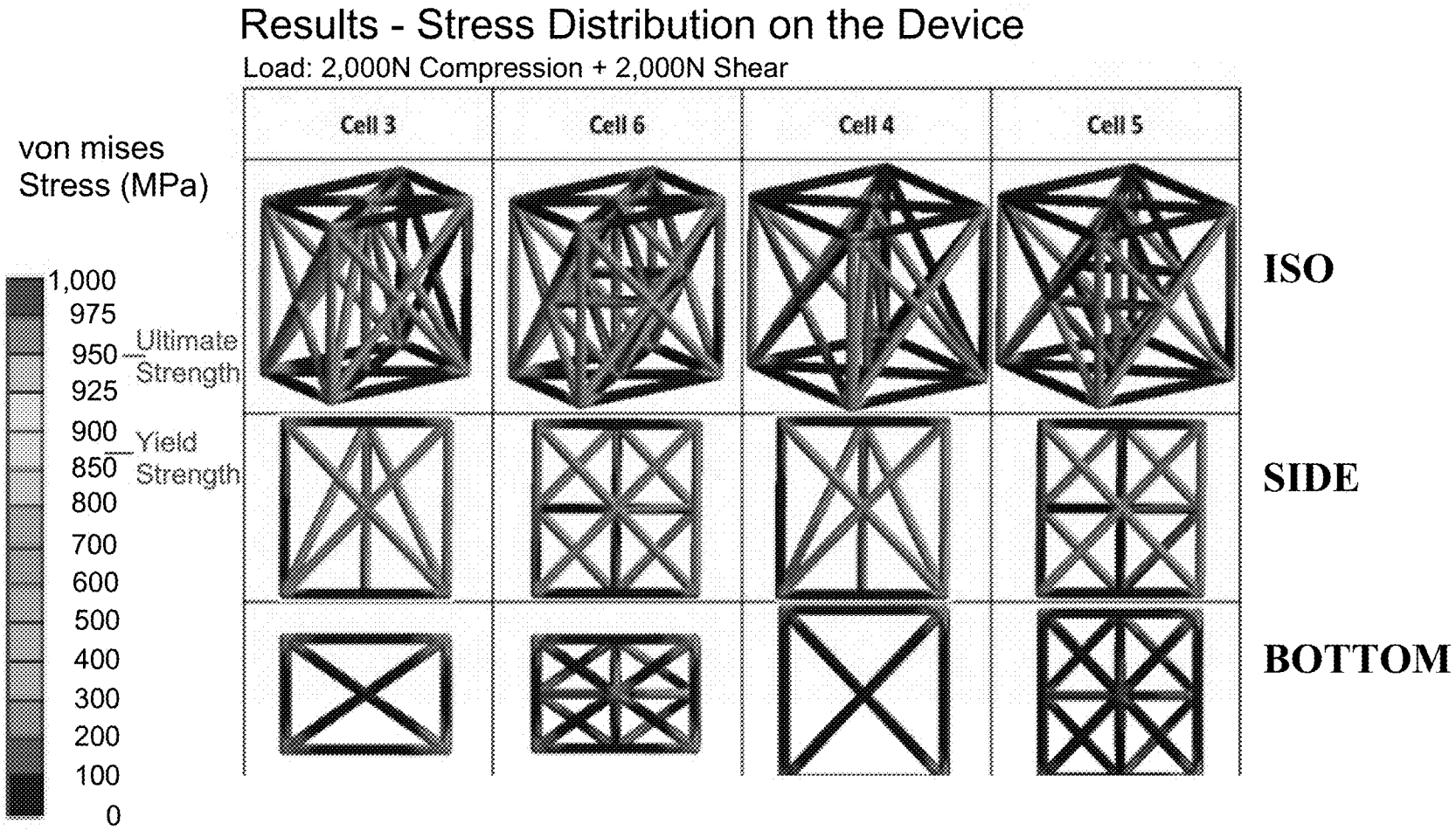
FIG. 21 shows representative view of FEA models following shear loading; and, FIG. 22 shows representative view of FEA models following torsion loading.
Figure 22:
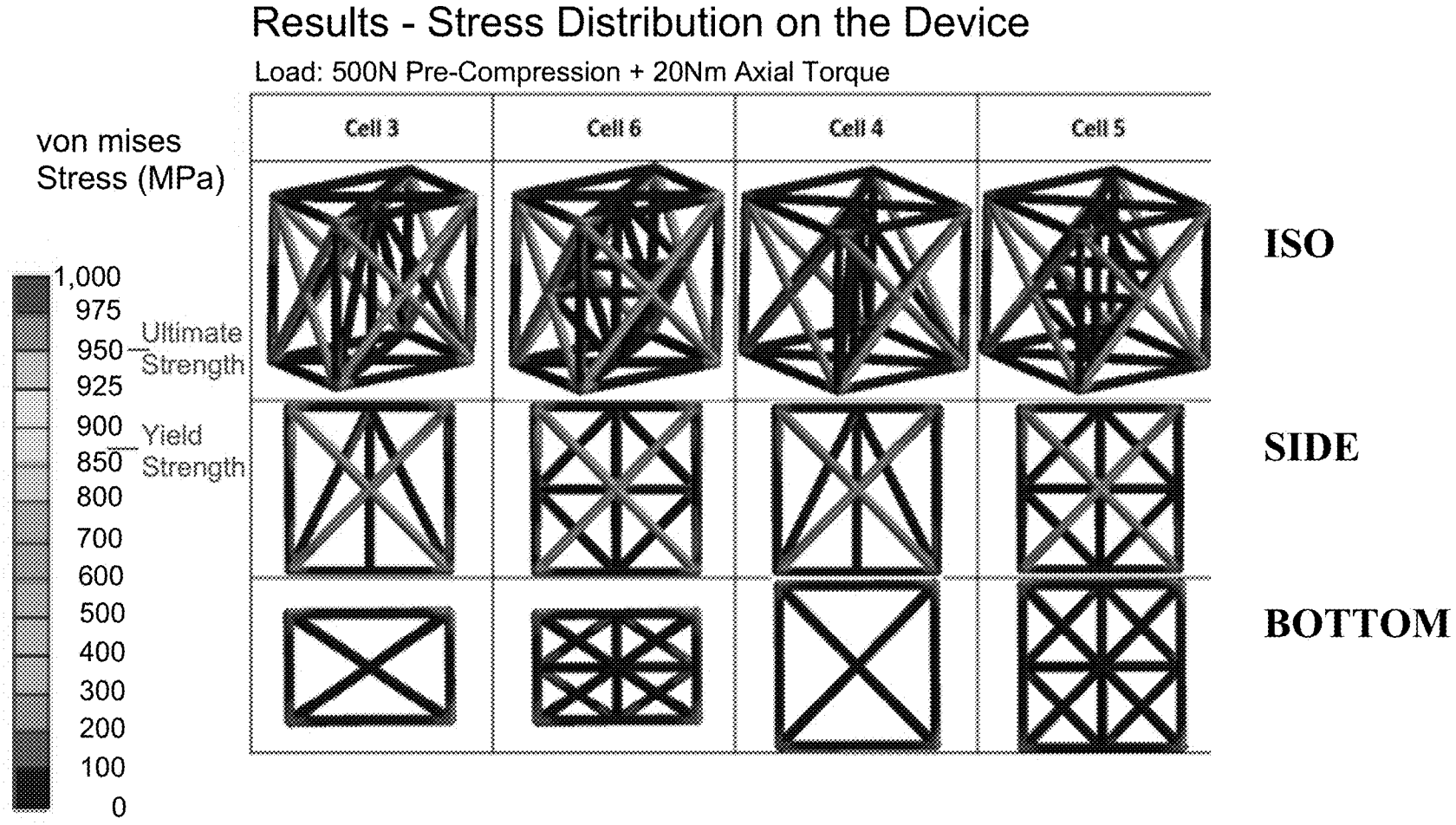

Finite Element models were created based on the mechanically tested samples. In the drawings that include FIG. 11, FIG. 16, FIG. 17 and FIG. 19-FIG. 22, the drawings show in color the von mises stress on each depicted structure as the result of force loads as described herein below, where color variations correspond to stress according to the von mises Stress shown in the legends to FIGS. 21 and 22. Referring again to the drawings, FIG. 11 shows FEA results for honeycomb testing: in panel A is a front view of a honeycomb structure having a 2 mm wall that was tested horizontally, and in Panel B are front and perspective views of a honeycomb structure having a 3 mm wall. The panels A and B each show the structures before and after testing (before and after indicated by the downward arrow), the lower images showing the same structures with an indication of the stress on the material. As shown visually in FIG. 11 and graphically in FIG. 12, the orientation and thickness of the honeycomb structures meaningfully influenced the energy dissipative performance. Again referring to FIG. 12, which shows load vs displacement, the resultant profiles are from top to bottom are: 3 mm wall thickness tested horizontally; 3 mm wall thickness tested vertically; and, 2 mm wall thickness tested horizontally; 2 mm wall thickness tested vertically. These data show that the stiffness in horizontal configuration is almost 2 times that of the vertical configuration, and an increase in wall thickness of the cell by 1 mm contributed to a stiffening of the structure by ~20%.

As shown in the drawings, the stresses in almost all structures in both configurations was almost evenly distributed across the cells and layers, the peak stress in cells were very close, except in cells of the last 2-3 rows (close to the fixed boundary where tissue would be), where the stresses were lower. The even distribution of the stress indicates that the displacement is almost equally distributed among the rows. In terms of selection of honeycomb material for a crush layer, greater deformation is desirable, as a stiffer structure results in less deformation, which would result in commensurately less acceleration and deceleration time. By identifying a desired threshold level for deformation and failure based on tissue and typical forces encountered in a particular activity, the crush material could be specifically tailored in terms of cell size, wall thickness, and orientation to achieve the desired energy dissipation for a selected area (in $mm^2$ or $cm^2$) of protective gear.

EXAMPLE 2: FEA TEST LOADING OF TRUSS STRUCTURE

Figure 13:
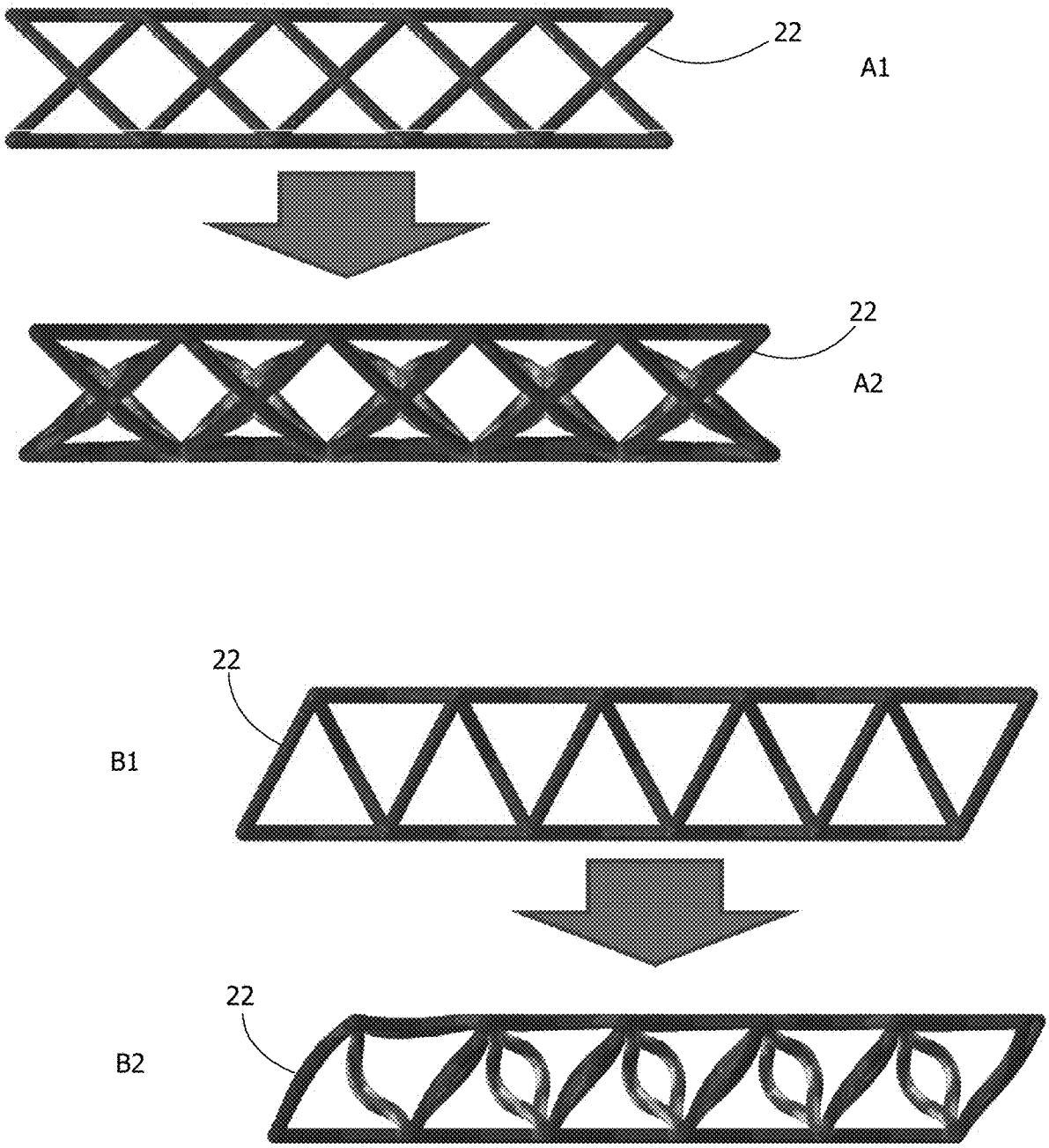
FIG. 13 shows examples of simple and complex truss structures that were analyzed by FEA under loading.

Referring again to the drawings, FIG. 13 shows examples of simple and more complex truss structures that were analyzed by FEA under loading. As show, the simple truss as compared to the more complex truss demonstrates greater deformation, and therefor a relatively greater energy dissipation under the same impulse load, which would contribute to a corresponding increase in deceleration time.

Figure 14:
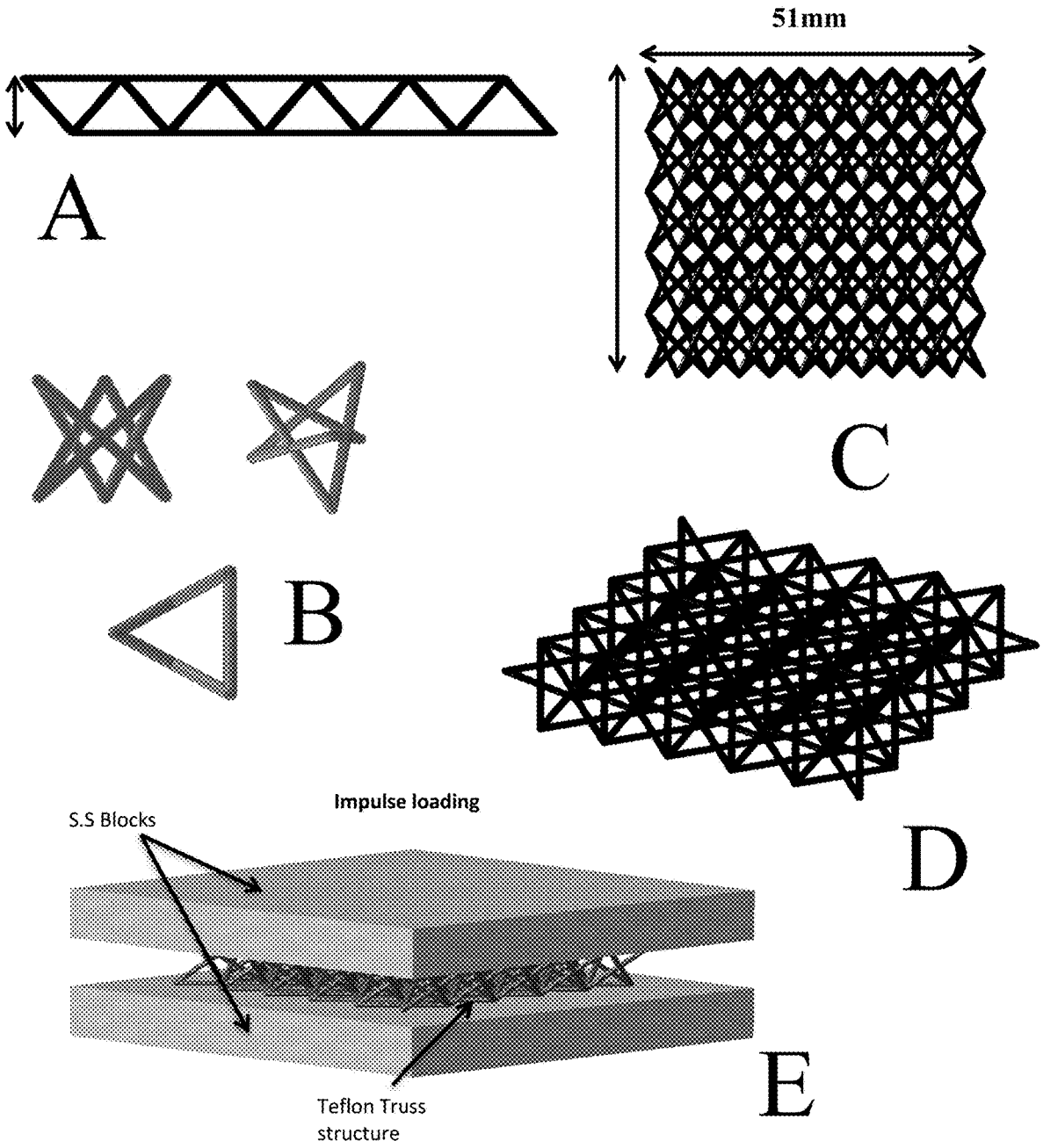
FIG. 14 shows behavior of truss structures for crush layers examined by FEA under compression, shear and torsional loads where a relatively simple truss is shown in Panel A, components of the truss assembly are shown in Panel B, examples of tested truss arrays are shown in Panels C and D and embedded in a FEA model in Panel E.

To more closely evaluate the behavior of truss structures for crush layers, as shown in FIG. 14, compression, shear and torsional studies were conducted with the simple truss assembly (components of the truss assembly shown in Panel B) in a truss array (Panels C and D) having a relatively simple truss (Panel A), arranged in a three-dimensional truss assembly and arrayed and embedded in a FEA model (Panel E). In the FEA set up, the CAD model of the Teflon polymer truss structure was sandwiched between stainless steel blocks and was imported into FEA software for analysis. Mechanical contacts were simulated between the truss structure and blocks at the contact interfaces. Components were meshed with tetrahedral (Truss structure) and Hex (Blocks), and mechanical properties were assigned to each component. Impact loading was simulated in the FEA model at a load rate according to the acceleration/time data reported by Zhang et al. for tissue injury.

Figure 15:
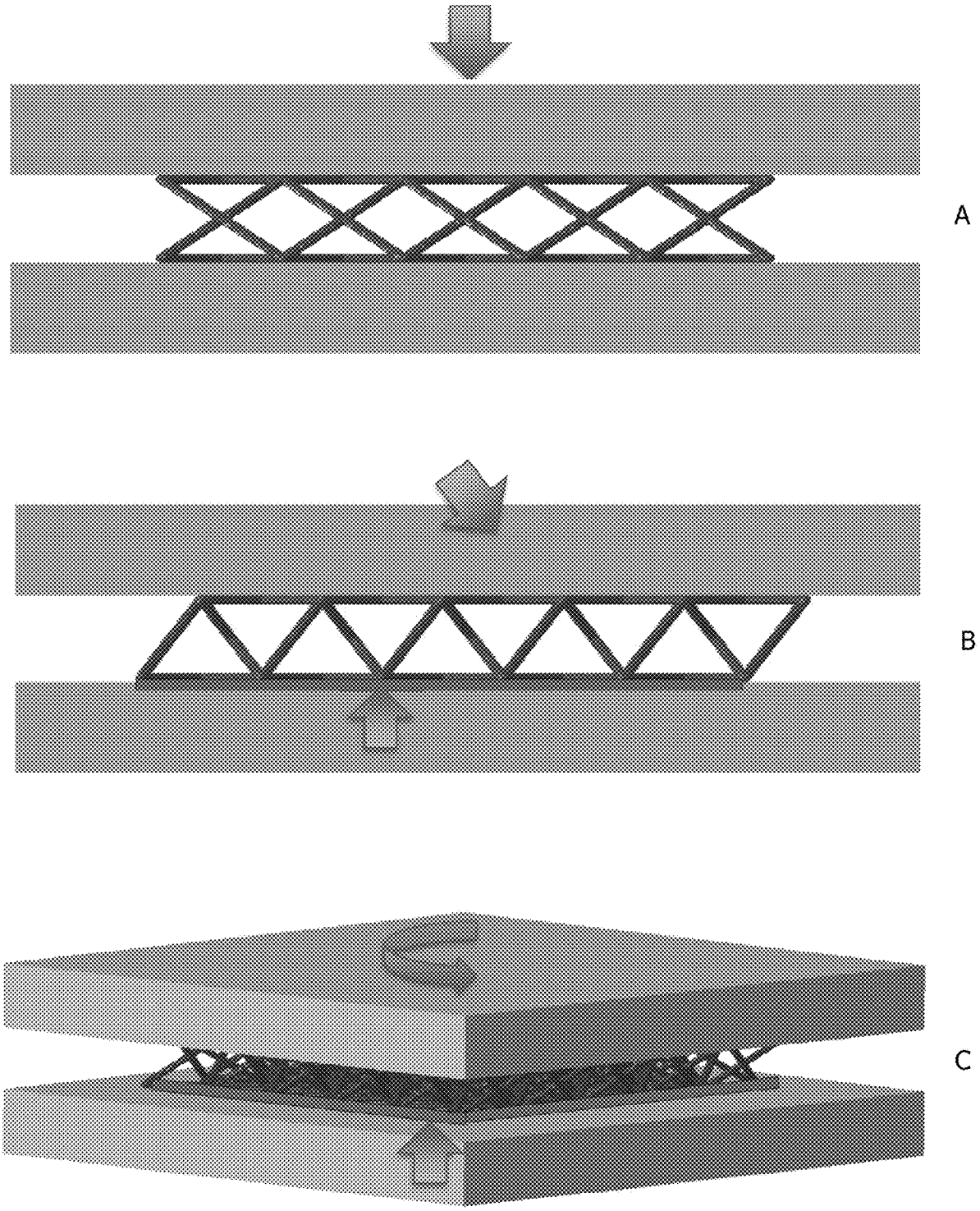
FIG. 15 shows a schematic of the various loading scenarios, with Panel A showing compression loading, Panel B showing shear loading, and Panel C showing torsional loading.

The following loading scenarios were simulated: Compression (impact load rate, peak load: 400 N); Compression-Shear (impact load rate, load at 45°, peak load: 600 N); and, Torsion (impact load rate+static pre-compression of 50 N, peak torque: 40 Nm). In all loading scenarios, the load was applied to the top block while the inferior block was fixed in all degrees of freedom. In Compression-Shear and Torsion loadings, but not Compression alone, a layer of synovial fluid (having a coefficient of friction: 0.1 and representing a possible slip layer in accordance with the embodiments described herein) was simulated between the contact surfaces of the Truss structure and lower block. Referring again to the drawings, FIG. 15 shows a schematic of the various loading scenarios, with Panel A showing compression loading, Panel B showing shear loading, and Panel C showing torsional loading. In each instance, as depicted, the arrows indicate the direction of forces applied to the FEA model and the location of the slip layer relative to the section of crush material. The conditions of FEA tests on the model included: Compression (impact load rate, peak load: 400 N); Compression-Shear (impact load rate, load at 45°, peak load: 600 N); and, Torsion (impact load rate+static pre-compression of 50 N, peak torque: 40 Nm.

Figure 16:
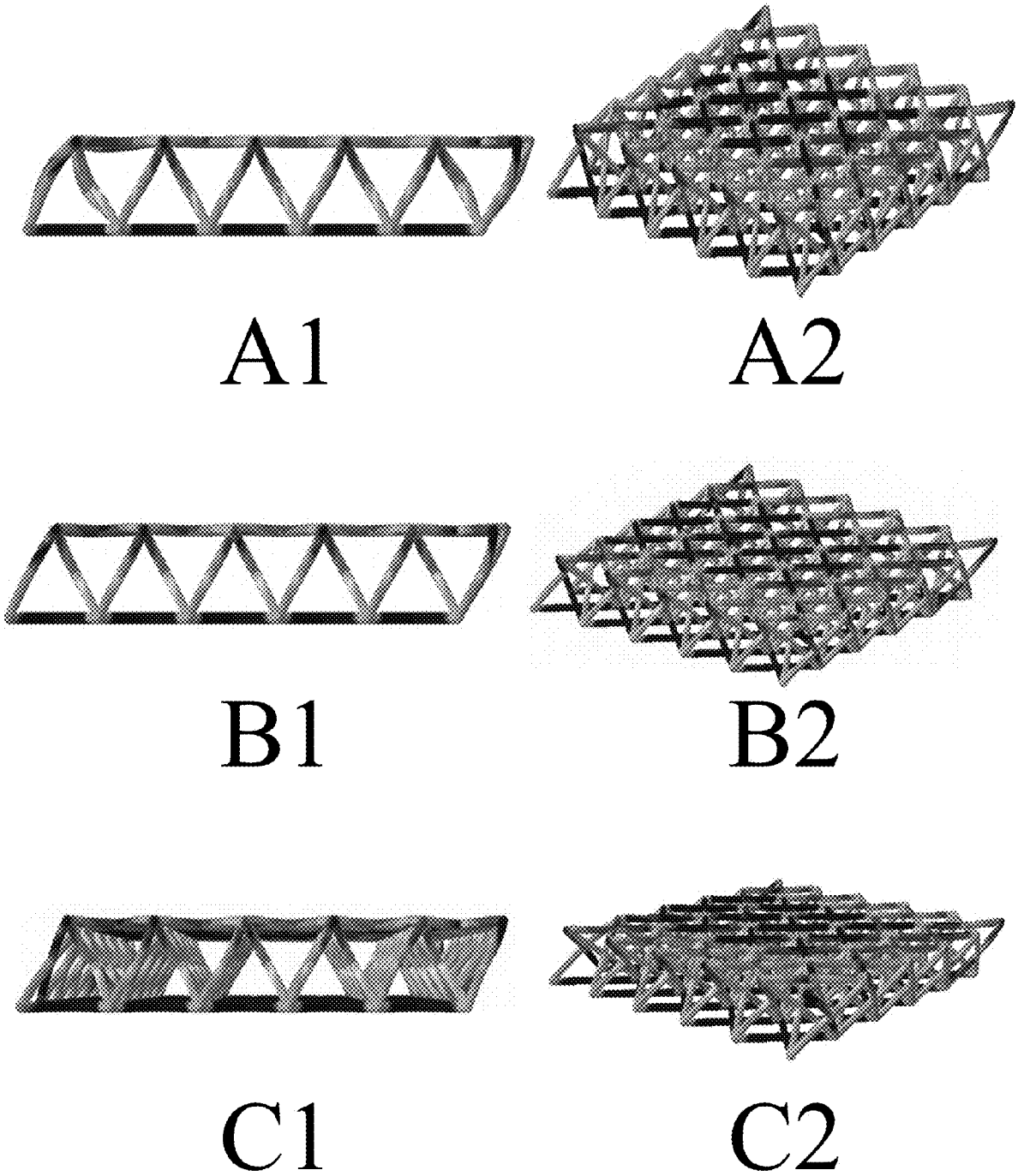
FIG. 16 shows side views of a component truss assembly subjected to compression, shear and torsion, respectively (in Panels A1, B1, and C1) and perspective views of the tested truss array (in Panels A2, B2 and C2)
Figure 17:
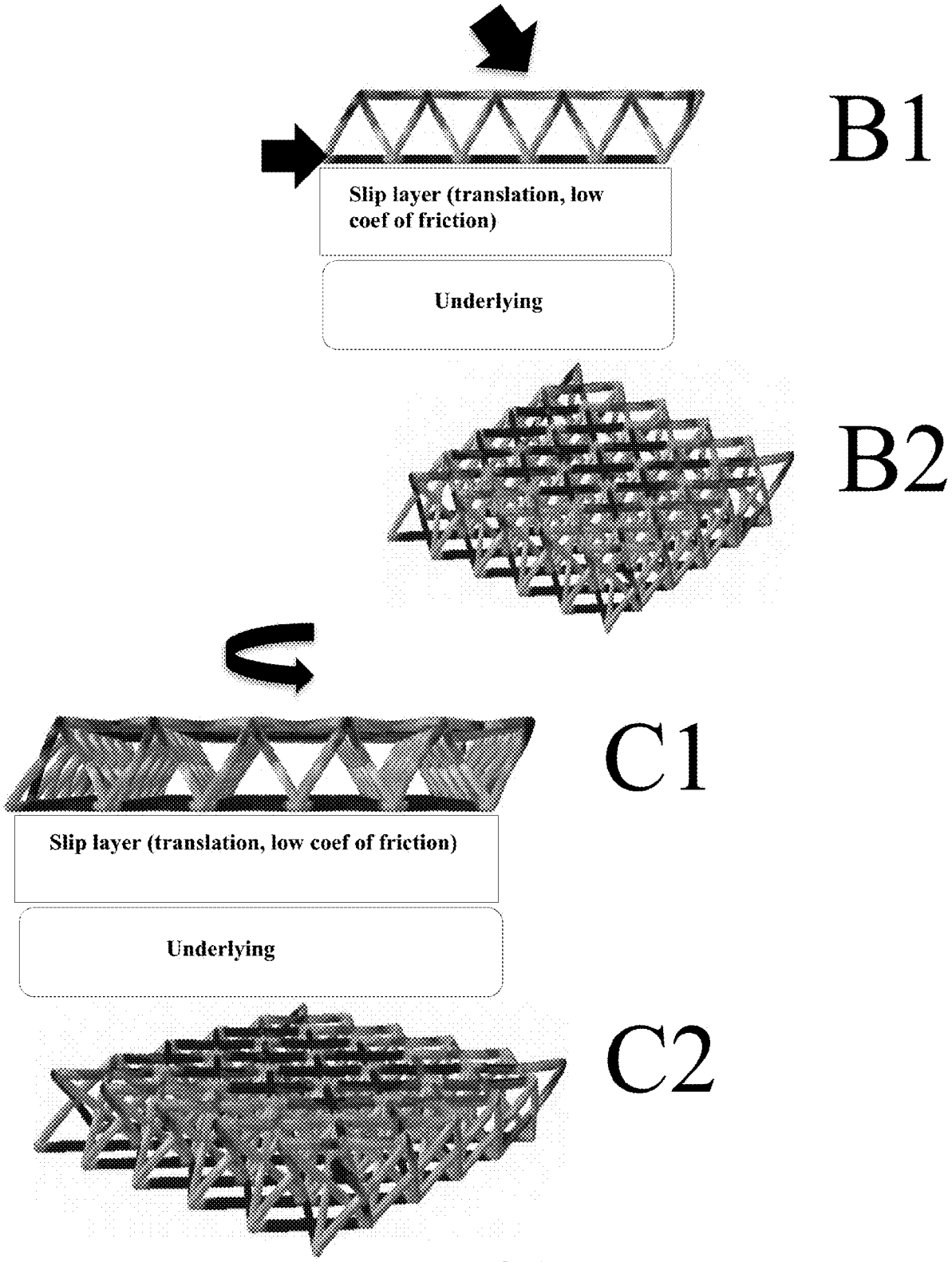
FIG. 17 shows in further detail effects of the slip layer on force transfer with respect to the shear and torsional models.

The resultant stress transfers under the three loading scenarios are shown in FIG. 16, which shows in Panels A-C for compression, shear and torsion, respectively, side views of a component truss assembly (A1, B1, and C1) and perspective views of the tested truss array (A2, B2 and C2). FIG. 17 shows in further detail effects of the slip layer on force transfer with respect to the shear and torsional models. With reference to the shear and torsional results, when the truss is impact loaded in the presence of a translation (slip) layer with coef friction 0.1, the slip layer basically eliminates force transfer to the underlying block (representing in the model tissue to be protected), as the energy is absorbed by the inner struts of the truss matrix (as indicated by the yellow arrows in FIG. 17).

As shown in the drawings, in the presence of the slip layer, the external skeleton of the truss structure has very low stress. The slip layer provides sliding or translation in shear loading which reduces the stresses (and energy transfer). This is clinically significant in the context of protective gear, as the slip layer effectively reduces the transfer of stress from the base of the truss which would be in closest proximity to the tissue to be protected. Referring again to FIG. 16, the results show that relatively more energy is absorbed and maintained within the inner truss matrices of the truss in the presence of the slip layer, while the compressive forces in the absence of the slip layer are more concentrated at the base of the truss and in closer proximity to the underlying tissue to be protected.

Figure 18:
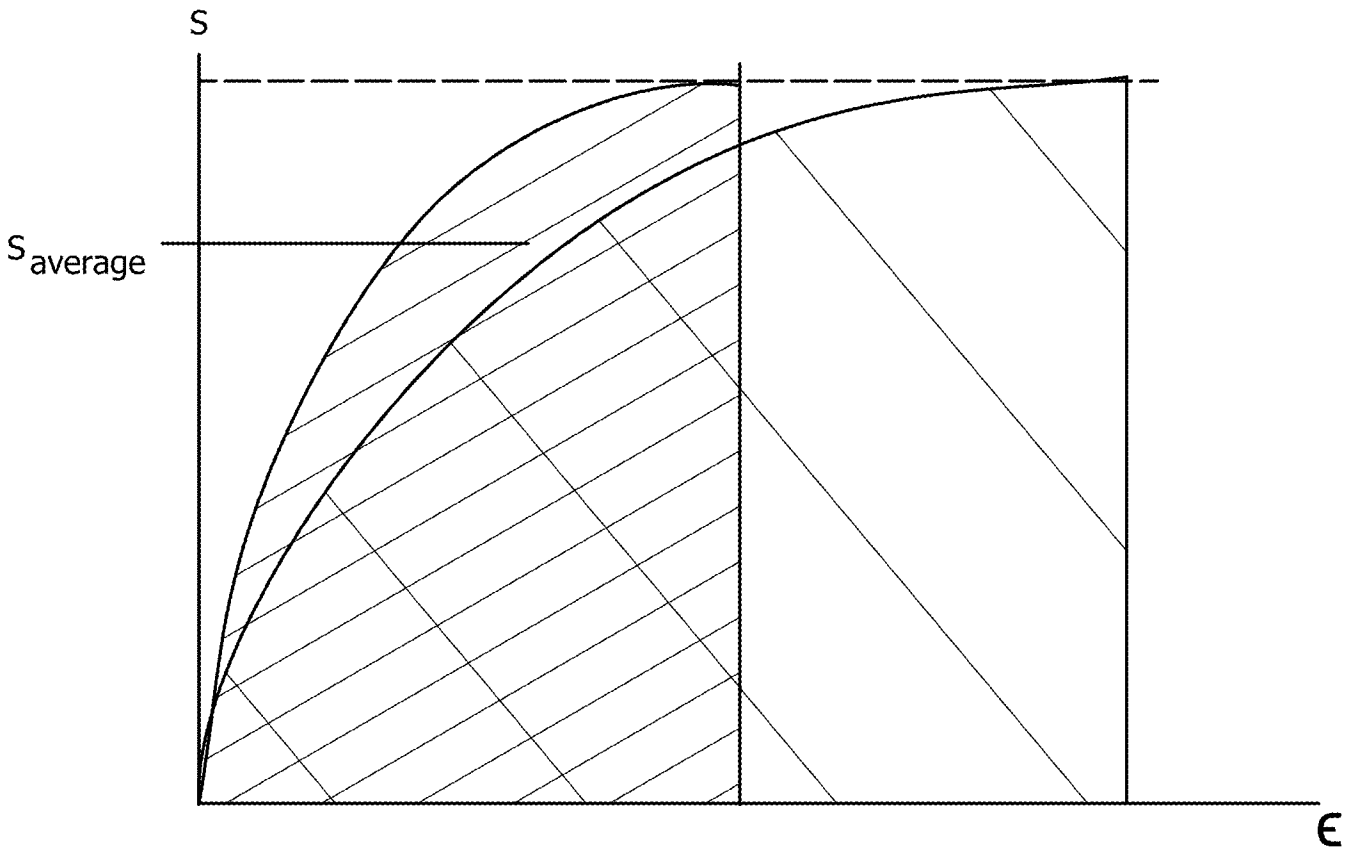
FIG. 18 shows the relationship of deformation & energy dissipation in FEA studies of truss structures wherein the Stress-Strain curve is obtained from a plot of load v. displacement (not shown)

Crush layers for protective gear according to this disclosure may be designed to specifically respond to the forces typically encountered by vulnerable tissues, based in part on the known information about tissue injury, as shown in the above examples, and consideration of the force dispersion properties of different crush materials. Custom tailoring of the crush material to maximize its deformation under select force loads, especially when combined with one or more slip layers, will enable effective energy dissipation away from tissue. This principle is illustrated in the curve shown in FIG. 18, which shows the relationship of deformation & energy dissipation. The Stress-Strain curve is obtained from a plot of load v. displacement (not shown). The red crosshatched curve and the black alternate crosshatched curve represent, respectively, the same stress (force/area). As reflected by the red curve—less displacement (strain) or deformation occurs with a stiffer construct, resulting in less energy being dissipated and commensurately greater energy being transferred to the adjacent material (body tissue to be protected, in the instance of a protective device). In contrast, as reflected by the black curve—greater deformation of material occurs with more flexion/translation, resulting in greater energy dissipation within the material, which is evident graphically as the larger amount of area under the black curve, and commensurately less energy being transferred to adjacent material.

EXAMPLE 3: FEA TEST LOADING OF VARIED TRUSS STRUCTURES

Figure 19:
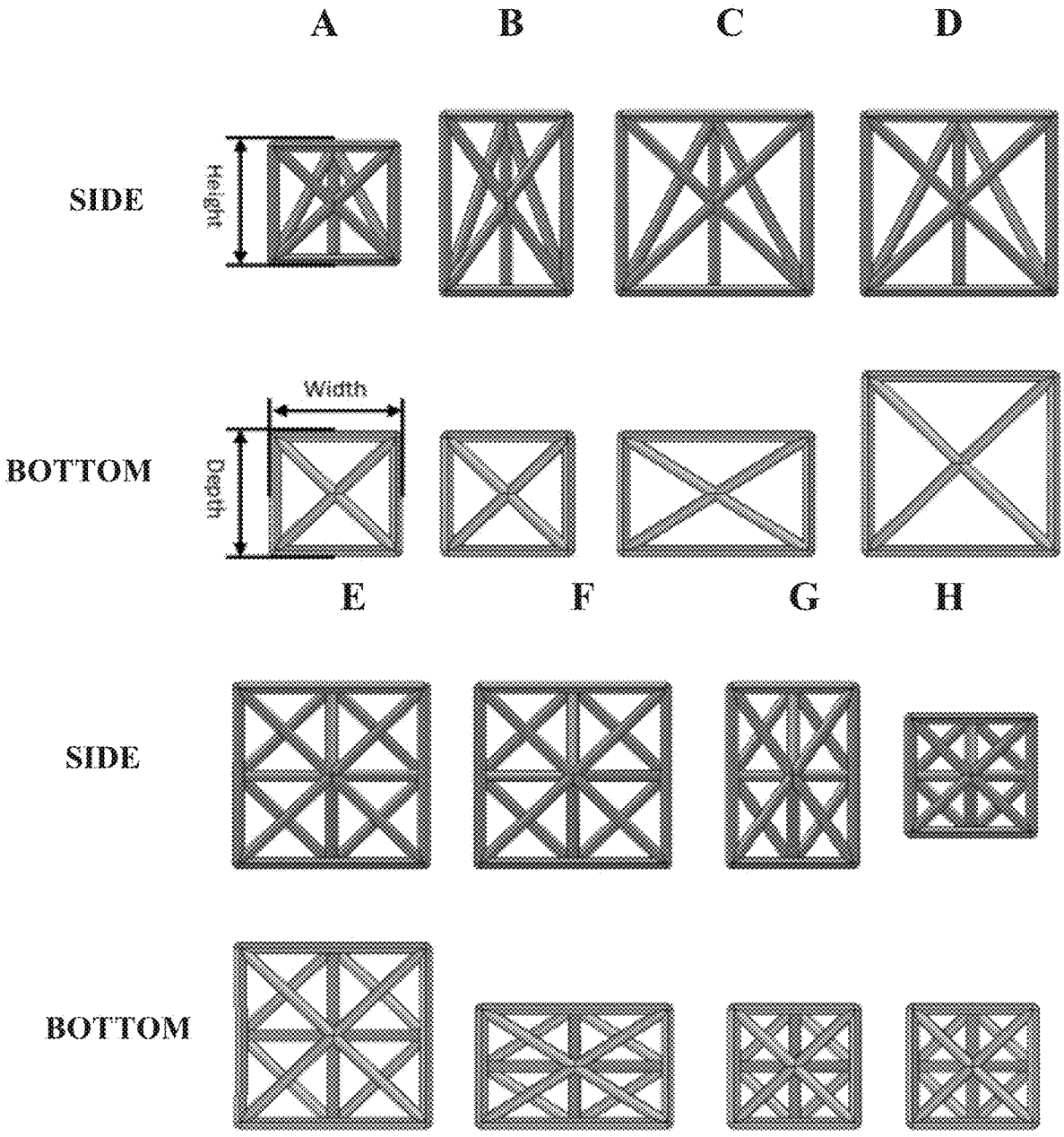
FIG. 19 shows a set of eight (8) distinct truss assemblies, which varied in the arrangement of braces, and struts was tested.
Figure 20:
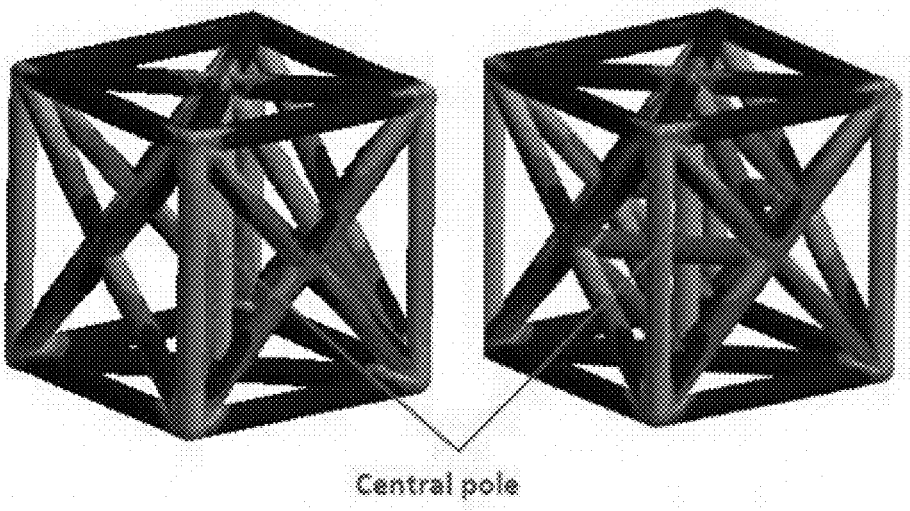
FIG. 20 shows representative view of FEA models following compression loading.
Figure 20:
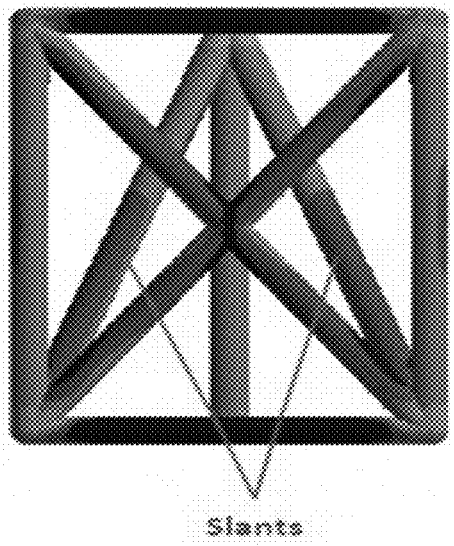

Referring again to the drawings, FIG. 19-FIG. 22 show various views of truss structures that were examined by FEA. Referring now to FIG. 19, a set of eight (8) distinct truss assemblies, which varied in the arrangement of braces, and struts was tested. Each assembly is referred to herein in the context of testing as a "cell structure" or "model" where each structure was formed of Titanuim (either Ti-6Al-4V (RAW), or Ti-6Ai-4V (HIP)), having a modulus of elasticity of about 113.8 GPa, a Poisson's Ratio of about 0.342, a yield strength of about 870 MPa, and a tensile strength of about 950 MPa; the strut and brace thickness was 1.25 mm, and each cell was selected from one of two structure types (see drawings) and had height/width/depth profiles of the following: 14.25 mm/14.25 mm/14.25 mm, 21.25 mm/14.25 mm/14.25 mm, 21.25 mm/21.25 mm/14.25 mm, and 21.25 mm/21.25 mm/21.25 mm. Each cell structure was sandwiched between stainless steel blocks. The cell & block models were imported into an FEA environment and meshed for computational analysis. The contact areas between a cell and block were fixed at superior and inferior contact interfaces; mechanical properties were assigned to each model's components (including, as noted above, material grade, modulus of elasticity, Poisson's ratio, yield strength (in MPa) and ultimate tensile strength (MPa). The cell and block models were analyzed for load displacement and stress distribution across the braces and struts under compressive, shear and torsional forces.

Compression Loading

The following loading scenario was simulated in each model: 4,000 N compression was applied to the superior surface of the top block while fixing the inferior block in all degrees of freedom. The following compression loading, as shown in representative view of FEA models in FIG. 20, was observed on different truss configurations: Larger area (footprint) of truss structure results in greater stress absorbed centrally for (greater for the Type II); Higher stress in slants connecting to central pole in Type I structure (Type II lacks slants); Higher stress absorbed centrally for Type II configurations. Conclusions—it is possible to directionally orient energy dissipation (through absorption in specific truss struts along axes by changing dimensions and strut dimensions).

Shear Loading

The following loading scenario was simulated in each model: 2,000 N compression plus 2,000 N anterior shear were applied simultaneously to the superior surface of the top block while fixing the inferior block in all degrees of freedom. The following compression and shear loading, as shown in representative view of FEA models in FIG. 21, it was observed on different truss configurations: Increase in area (footprint size)—no difference in stress absorption, same for both configurations; Greater height of the structures significantly increased stress (energy) absorbed in struts. Conclusion—it is possible to directionally orient energy dissipation (through absorption in specific truss struts along axes by changing dimensions and strut dimensions. [Ex. Increase height along a Vertical axis=longer vertical struts will bend or deform more due to greater bending moment and increase energy dissipation along the longitudinal axis].

Torsion Loading

The following torsion loading scenario was simulated in each model: 500 N pre-compression load followed by a gradually increasing Torque (Max: 20 Nm) applied to the superior surface of the top block while the inferior block is fixed in all degrees of freedom. The stress distribution across struts was compared among the different truss models. The following torsional loading, as shown in representative view of FEA models in FIG. 22, it was observed on different truss configurations: The peak stress did not increase significantly as either depth or width of the cell increased, however the peak stress decreased ~25% when both dimensions increased (unchanged aspect ratio); The peak stress in all designs occurred at the intersection of the struts in the lateral planes of the cell; The stresses across vertical poles were smaller in magnitude than in the angled struts; Difference in peak stress was less than 3% in type I versus type II structure; The peak stress did not increase significantly as either depth or width of the cell increased, however the peak stress decreased by 25% when both dimensions increased (unchanged aspect ratio). Conclusion—it is possible to directionally orient energy dissipation (through absorption in specific truss struts along axes) by changing dimensions and strut dimensions. [Ex. Increase height along a Vertical axis=longer vertical struts will bend or deform more due to greater bending moment and increase energy dissipation along the longitudinal axis]

Establishing Performance Parameters of Component Layers

Embodiments disclosed herein include in various combinations composite component layers and devices that comprise combinations of component layers adapted for protection against various types of direct and indirect impact trauma. In some specific embodiments, the devices comprise specific composite component layer combinations tailored to specific tissue types to protect against modes of traumatic injury that are specific to the tissue type.

The performance parameters of the component layers and the composites of component layers are established based on the tissue to be protected, the nature and extents of injury inducing forces typically experienced by the tissues in the context of an activity, and the material properties of the component materials and/or component layers. Provided herein below are certain representative considerations regarding forces, testing approaches, and modes of possible failure of component materials, component layers and devices formed with component layers.

To establish the 'proof of concept' for a particular protective device with respect to energy dissipation and the control of the dissipation, each layer is independently mechanically tested for a variety of different design configurations at different force and/or strain rates. In one aspect, the mechanical tests assess single and multiple repetitive loading applications for multiple and combined planes of motion at multiple sites for each component layer. Specifically, mechanical assessments include compression, shear, rotational, linear, offset linear, combined angular rotation with linear, and combinations of these.

Methods for Testing and Evaluating the Shell/Slip/Crush Layers

Initially, mechanical tests—impact and dynamic will be conducted in multiple planes of motion (compression/shear/rotation) to assess the performance and attenuation characteristics of the combined protective layers (shell/slip/crush) in a planar fashion (cubes with the different layer and crush configurations). Various configurations will be assessed to quantify energy absorption of the layers as a whole construct. High force materials test machines and impact testers with sensing chambers will be utilized to apply controlled impact or dynamic cyclical forces and measure the displacements, accelerations, and duration of the impact loads for different configurations of the layers. The energy absorbed will be quantified for the various configurations with the optimal configurations applied to actual helmets for a second phase of testing.

Methods for Testing and Evaluating Protective Gear: Helmet Testing

There are numerous standards, per NOCSAE (National Operating Committee on Standards for Athletic Equipment) and ASTM (American Society for Testing Materials), that detail the test methods for helmet and other protective gear testing. Existing standards for helmet performance include: SNELL Standards: URL: www.smforg/testing; NOCSAE Standards: http://nocsae.org/; ASTM Standards: http://www.astm.org, including F717, F513, F429, F1163, F1447, F1045, F1492. These standards allow quantification of the performance and shock attenuation characteristics for these products.

In accordance with the disclosure, more specific methods of testing are described prospectively herein that would supplement and potentially supplant the currently accepted testing for protective gear, particularly helmets.

To quantify the slip and crush layers from a protective and shock attenuation perspective, actual helmets will be tested with conventional foam (per the manufacturer) and then compared to the same helmet design (and manufacturer) with the supplied shock absorption layer removed and replaced with the proposed slip and crush layer construct. Thus, a direct comparative between conventional helmets having an outer shield layer and inner padding layers, and helmets according to this disclosure that comprise an outer shield layer, at least one slip layer and a crush layer that is configured to use for a specific activity or sport.

Standardized head forms with multi-planar accelerometers, such as the Hybrid III dummy, will be used to quantify helmet performance and measured peak acceleration at impact for a variety of combinations and configurations of the slip and crush layers within each helmet. The Hybrid III dummy comes in a variety of sizes and has models that represent pediatric and adult head and neck complexes. These standardized test methods (per published ASTM standards) will be followed to quantify the force and acceleration attenuation that the helmets experience under simulated sports impact and rotational kinematics.

The test helmets in accordance with this disclosure will have molded slip and crush layers that will encompass the entire contours of the helmets and/or be strategically sectioned and spaced throughout the helmet in sections, thus providing different scenarios of attenuation evaluation. The severity of the head responses will be measured by a severity index, translational, and rotational acceleration. The results of attenuation will be compared to the biomechanical thresholds that cause concussions and different extremes of diffuse axonal injury which are documented in the literature.

In some embodiments, analytical (non destructive) tests including imaging tests may be used to establish the extent to which a protective article is spent or depleted in its energy dissipative capacity. In one example, such analysis can establish the extent (on a percentage or other basis) to which one or more of slip, crush, and break-away layers remain intact through a period of use. When a threshold of compromise is met, the article can be declared retired.

Shield component layer performance specifications are assessed with consideration of: Selection from materials with different coefficients of friction; Quantification of hardness of material—static and dynamic forces on material—destructive testing; Quantification of compliance of material-static and dynamic forces on material—nondestructive followed by destructive testing; Test for impact resistance—single impacts at different forces/accelerations; Bending and deformation strength for different force and/or strain rates; Slip/slide/abrasion testing—quantify coefficient of friction and slip potential; and, Repeat tests for different environmental conditions (ambient vs. extreme heat or cold).

Crush component layer performance specifications are assessed with consideration of: Different materials with different geometrical designs and dimensions in multiple vs. specific orientations. Quantify crush times and responses to linear, off-axis, and angular (rotational) impacts; Quantify repetitive impact with increasing forces at the same area, starting at low load to induce small crush and increase to obtain 75% full crush and quantify energy dissipation; Quantify amount of crush at different impact forces—establish thresholds for single impact model and multiple non destructive impact model; and, Test for impact resistance—single impacts at different forces/accelerations.

Slip component layer performance specifications are assessed with consideration of: Different materials to contain air or a fill material with different viscosities to form the slip layers—will plan to quantify extent of slip response and deformation, different coefficient of friction, displacements and time to displace; Quantify compliance of material—static and dynamic tensile forces on materials and combined materials (i.e. filled chamber)—nondestructive followed by destructive testing; and, Test for impact and burst resistance—single impacts at different forces/accelerations.

Break-away component layer performance specifications are assessed with consideration of: Different materials with different geometrical designs and dimensions in multiple vs. specific orientations; Quantify crush times and responses to linear, impact in different directions and different loads (shear, combined shear with rotation, pure linear etc.); and, Quantify threshold forces for breakaway patterns.

Combined layer performance specifications are assessed with consideration of: Run similar tests conducted for each of the individual component layers for multiple combinations of layers.

While various inventive aspects, concepts and features of the general inventive concepts are described and illustrated herein in the context of various exemplary embodiments, these various aspects, concepts and features may be used in many alternative embodiments, either individually or in various combinations and sub-combinations thereof. Unless expressly excluded herein all such combinations and sub-combinations are intended to be within the scope of the general inventive concepts. Still further, while various alternative embodiments as to the various aspects, concepts and features of the inventions (such as alternative materials, structures, configurations, methods, devices and components, alternatives as to form, fit and function, and so on) may be described herein, such descriptions are not intended to be a complete or exhaustive list of available alternative embodiments, whether presently known or later developed.

Those skilled in the art may readily adopt one or more of the inventive aspects, concepts, or features into additional embodiments and uses within the scope of the general inventive concepts even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary, or representative values and ranges may be included to assist in understanding the present disclosure; however, such values and ranges are not to be construed in a limiting sense and are intended to be critical values or ranges only if so expressly stated. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention. Descriptions of exemplary methods or processes are not limited to inclusion of all steps as being required in all cases, nor is the order that the steps are presented to be construed as required or necessary unless expressly so stated.

What I claim:

1. A protective article for shielding a body part from injury, comprising:

a chest protector sized to cover at least the chest portion of a wearer's body area when donned, the chest protector comprising an assembly of layers comprising an outer friction mitigating layer, and at least one crush component layer, each of the at least one crush component layer formed of an open architectural structure comprising one or more elements selected from the group consisting of multi-planar truss assemblies, honeycomb structures, and combinations thereof, each crush component layer being destructively deformable by breakage of one or more elements of the open architectural structure, wherein the protective article dissipates linear impact loads ranging from 20 to 1000 $N/m^2$.

2. The protective article according to claim 1, wherein the outer friction mitigating layer has a low coefficient of friction from less than to approximately equal to the coefficient of friction of ice at 0 degrees C., and due to the low coefficient of friction when in contact with another surface the protective article is capable of inducing slipping to initially influence deflection of impact to the chest area of the wearer.

3. The protective article according to claim 1, wherein each one of the at least one crush component layers of the protective article dissipates linear impact loads ranging from 20 to 1000 $N/m^2$.

4. The protective article according to claim 1, comprising either a securement feature comprising a flexible harness wherein the harness comprises a garment selected from a shirt and a vest, and wherein the garment is wearable separate from the chest protector and is adapted to receive chest protector components and replacement chest protector components, or a pliable sleeve that allows a conforming close fit to the wearer's body part, the assembly of layers affixed to the pliable sleeve, or a combination thereof.

5. The protective article for shielding a body part from injury according to claim 1 comprising a pliable sleeve that allows a conforming close fit to the wearer's body part.

6. The protective article according to claim 1, comprising at least one slip component layer comprising flowable material, wherein the flowable material of the at least one slip component layer comprises one or more lubricious components, provided in a matrix, or free flowing, or in sections, or a combination thereof.

7. The protective article according to claim 6, wherein at least one of the crush component layers and slip component layers, or a combination thereof is suspended in a flexible or rigid fabric or net and is affixed to at least one other crush component layer, slip component layer, an interior surface of the outer friction mitigating layer, or a combination thereof.

8. The protective article according to claim 6, wherein a crush component layer is situated between the outer friction mitigating layer and a slip component layer.

9. The protective article according to claim 6, wherein each one of the at least one crush component layers and at least one slip component layers of the protective article dissipates linear impact loads ranging from 20 to 1000 $N/m^2$.

10. The protective article according to claim 1, comprising at least two crush component layers.

11. The protective article according to claim 1, wherein at least one of the at least one crush component layer comprises at least one multi-planar truss assembly.

12. The protective article according to claim 11, wherein at least one of the at least one crush component layer comprises a layer of two or more multi-planar truss assemblies.

13. A protective article for shielding a body part from injury, the article comprising a chest guard, comprising:

a frame comprising a shield component layer that is rigid and has an outer surface that comprises an outer friction mitigating layer, the shield component layer having a hardness and a brittleness, and being capable of elastically deforming prior to fracture; and a component layer assembly comprising at least one crush component layer formed of at least one truss assembly that is destructively deformable by breakage; and at least one slip component layer, wherein the component layer assembly is insertable within the frame, and wherein the component layer assembly and frame may be preassembled and donned as one piece by a wearer, or it may be disassembled such that the component layer assembly may be donned by a wearer, and the frame may be attached to complete the protective article; and wherein the article is capable of dissipating linear impact loads ranging from 20 to 1000 $N/m^2$.

14. The protective article for shielding a body part according to claim 13, comprising a flexible harness comprising a garment selected from a shirt and a vest, wherein the garment is wearable separate from the frame and is adapted to receive the component layer assembly.

15. The protective article for shielding a body part according to claim 13, wherein each one of the at least one crush component layers of the protective article dissipates linear impact loads ranging from 20 to 1000 $N/m^2$.

16. The protective article according to claim 13, wherein the at least one slip component layer comprises flowable material that comprises one or more lubricious components, provided in a matrix, or free flowing, or in sections, or a combination thereof, and wherein at least one of the crush component layers and slip component layers of the component layer assembly is suspended in a flexible or rigid fabric or net and is affixed to an interior surface of the frame.

17. The protective article according to claim 16, wherein each one of the at least one crush component layers and at least one slip component layers of the protective article dissipates linear impact loads ranging from 20 to 1000 $N/m^2$.

18. The protective article according to claim 13, wherein at least one of the at least one crush component layers comprises at least one multi-planar truss assembly or a layer of two or more multi-planar truss assemblies.

19. A protective article for shielding a body part from injury, the article comprising a chest guard, comprising:

a frame comprising a shield component layer that is rigid and has an outer surface that comprises a friction mitigating layer, the shield component layer having a hardness and a brittleness, and being capable of elastically deforming prior to fracture; and a component layer assembly of at least one crush component layer, the at least one crush component layer formed of at least one truss assembly that is destructively deformable by breakage, wherein the at least one truss assembly comprises at least one multi-planar truss assembly or a layer of two or more multi-planar truss assemblies; and at least one slip component layer comprising flowable material that comprises one or more lubricious components, provided in a matrix, or free flowing, or in sections, or a combination thereof, wherein the component layer assembly is insertable within the frame, and wherein the component layer assembly and frame may be preassembled and donned as one piece by a wearer, or it may be disassembled such that the component layer assembly may be donned by a wearer, and the frame may be attached to complete the protective article; and wherein the article is capable of dissipating linear impact loads ranging from 20 to 1000 $N/m^2$.

20. The protective article according to claim 19, wherein each one of the at least one crush component layers and at least one slip component layers of the protective article dissipates linear impact loads ranging from 20 to 1000 $N/m^2$.

* * * * *